US011731859B2

(12) United States Patent
De Wolff

(10) Patent No.: US 11,731,859 B2
(45) Date of Patent: Aug. 22, 2023

(54) VACUUM ADHESION SYSTEM

(71) Applicant: Biomimetic Innovations Holding B.V., Enschede (NL)

(72) Inventor: Tjitte Iede De Wolff, Enschede (NL)

(73) Assignee: SUCCOR B.V., Enschede (NL)

( * ) Notice: Subject to any disclaimer, the term of this patent is extended or adjusted under 35 U.S.C. 154(b) by 372 days.

(21) Appl. No.: 16/967,545

(22) PCT Filed: Feb. 12, 2019

(86) PCT No.: PCT/NL2019/050091

§ 371 (c)(1),
(2) Date: Aug. 5, 2020

(87) PCT Pub. No.: WO2019/156567

PCT Pub. Date: Aug. 15, 2019

(65) Prior Publication Data

US 2021/0221650 A1 Jul. 22, 2021

Related U.S. Application Data

(60) Provisional application No. 62/629,595, filed on Feb. 12, 2018.

(51) Int. Cl.
*B66C 1/02* (2006.01)

(52) U.S. Cl.
CPC ..... *B66C 1/0218* (2013.01); *B66C 1/0212* (2013.01); *B66C 1/0256* (2013.01)

(58) Field of Classification Search
CPC ... B66C 1/0218; B66C 1/0243; B66C 1/0256; B25J 15/0683; B25J 13/081; B25J 13/082; B25J 13/085
USPC ..... 294/185
See application file for complete search history.

(56) References Cited

U.S. PATENT DOCUMENTS

| | | | | |
|---|---|---|---|---|
| 3,028,131 A | | 4/1962 | Beck | |
| 3,240,525 A | * | 3/1966 | Wood | B65G 49/061 294/185 |
| 3,656,794 A | * | 4/1972 | McCord | B65B 35/18 D7/688 |
| 5,013,075 A | | 5/1991 | Littell | |
| 5,244,242 A | * | 9/1993 | Goedecke | B65G 47/91 294/185 |
| 6,817,639 B2 | * | 11/2004 | Schmalz | B65G 47/91 294/185 |
| 7,673,914 B2 | * | 3/2010 | Liao | F16B 47/00 294/185 |

(Continued)

FOREIGN PATENT DOCUMENTS

EP 3181027 6/2017

*Primary Examiner* — Dean J Kramer
(74) *Attorney, Agent, or Firm* — Joseph F. Aceto, Esq

(57) ABSTRACT

The invention relates to a vacuum adhesion system, comprising at least one suction cup having a suction surface for attaching to a surface at least one system module, comprising at least one vacuum pump connecting to the suction cup for applying a vacuum to the suction surface for providing suction adhesion at least one indicator or sensor for indicating or measuring a pressure differential in the suction cup at least one interface for communicating the measured pressure differential or a value based thereon and a processor for controlling the vacuum adhesion system.

15 Claims, 22 Drawing Sheets

(56) References Cited

U.S. PATENT DOCUMENTS

| | | | | |
|---|---|---|---|---|
| 8,070,203 | B2 * | 12/2011 | Schaumberger | B66C 1/0243 294/186 |
| 9,061,868 | B1 * | 6/2015 | Paulsen | B66D 3/18 |
| 2015/0375401 | A1 * | 12/2015 | Dunkmann | B25J 15/0061 294/185 |

* cited by examiner

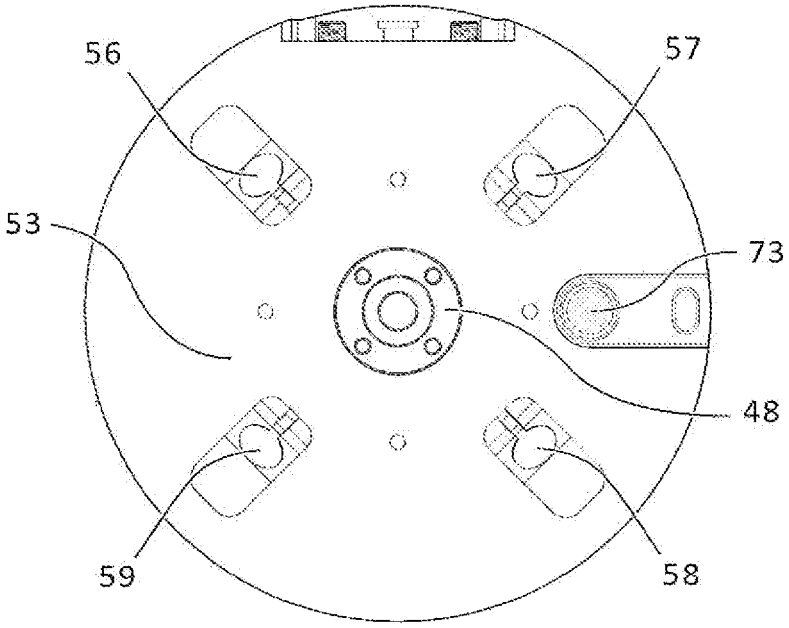
*Fig. 18*
*Fig. 19*
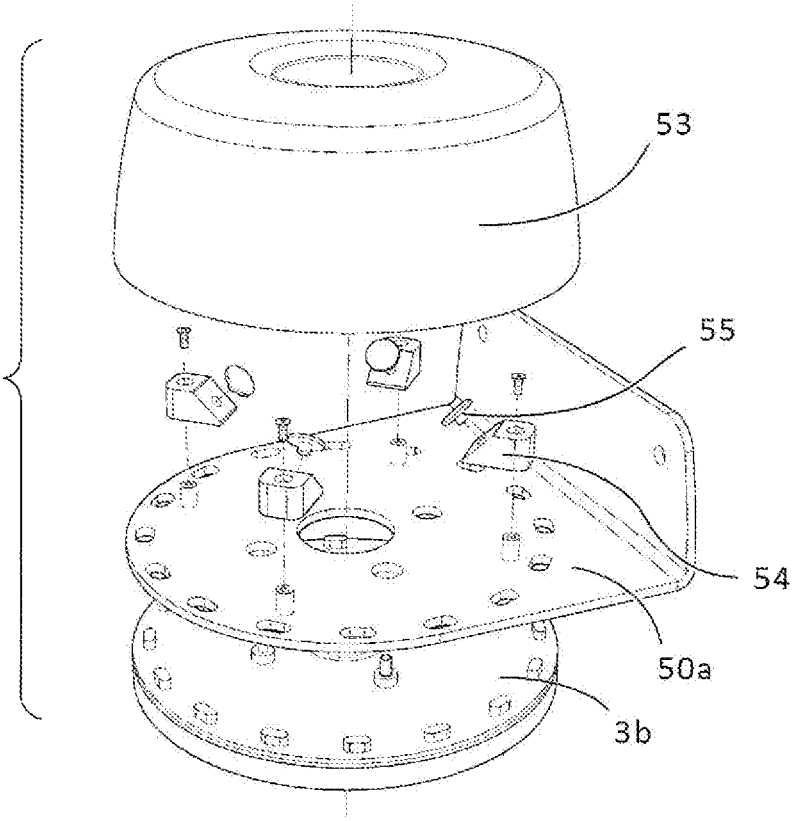

VACUUM ADHESION SYSTEM

PRIORITY CLAIMS AND RELATED PATENT APPLICATIONS

This application is the US national application of PCT/NL2019/050091, filed on 12 Feb. 2019, and which claims priority to U.S. Provisional Application Ser. No. 62/629,595, filed on 12 Feb. 2018, the disclosure of which is herein incorporated in its entirety.

FIELD OF THE INVENTION

The present invention relates to a vacuum adhesion system that is used for lifting and handling objects. More particularly the invention relates to systems, designs and fabrication methods that provide devices with reversible adhesion. Such devices create a strong adhesive force that can be controlled by varying the degree of vacuum underneath a suction cup.

BACKGROUND OF THE INVENTION

Existing vacuum adhesion systems can generally be divided into two groups. The first group contains all systems that are powered by hand, i.e. manual vacuum adhesion systems, while the second category covers all vacuum adhesion systems that are motorized and require a power source such as electric power.

Manual vacuum adhesion systems can only be used in a limited amount of applications, because they do not work well on rough surfaces. These devices can detach themselves from an object without warning when a leakage occurs from underneath the rim of the suction cup, leading to dangerous situation which can cause bodily harm.

On the other hand, motorized vacuum adhesion systems are safer and can lift a wide variety of materials. However, these systems require heavy components such as large vacuum pumps and big batteries, which compromises their mobility. Since they are cumbersome to bring along they have limited applications, which means that people who work outside of controlled production environments, such as construction workers and couriers, cannot freely use them. Therefore, activities that involve lifting or handling heavy objects are often carried out without any lifting aids, which leads to physical overburdening and injuries. In the long term this results in high costs for both employers and employees due to worker absenteeism and medical expenses.

To provide a solution for these problems, the invention that is presented here contains the designs for a type of suction cup that may require a small amount of power to be actuated. As a result thereof, vacuum adhesion systems that make use of these suction cups may be light enough to be carried by hand and can be taken along to a jobsite. To maximize the number of objects that can be lifted with the vacuum adhesion system its capabilities can be adjusted. Furthermore, the characteristics of the suction cup presented here allows the vacuum adhesion system to attach itself to objects with a wide variety of surfaces.

A further or alternative goal of the invention disclosed here is to increase the safety of vacuum adhesion systems in general. Most vacuum adhesion systems that are on the market have an alarm function that alerts a user when the level of vacuum drops below a certain working pressure. An inherent downside to this kind of functionality is that the alarm is only triggered when the vacuum level becomes low and the suction cup has already started to detach itself from the object. Therefore, the vacuum adhesion system presented here aims to provide warnings at an earlier stage, in order to allow the operator to act before hazardous situations arise. This is achieved by providing a better insight into the processes occurring underneath the suction cup. The system is for example able to determine the maximum allowable load and current load on each individual suction cup and shares this information through an interface. Additionally, the system is equipped to independently prevent dangerous situations from occurring by acting upon this information. In this way the impact of user errors is reduced, and the system can respond quickly to disturbances, while at the same time being more energy efficient. A device containing such a vacuum adhesion system and one of the suction cups disclosed here is therefore referred to as a smart suction cup.

SUMMARY OF THE INVENTION

The invention relates to a vacuum adhesion system according to any of claims 1 to 23.

In an embodiment of the vacuum adhesion system according to the invention, the vacuum adhesion system comprises at least one suction cup having a suction surface for attaching to a surface. The vacuum adhesion system furthermore comprises at least one system module, comprising at least one vacuum pump connecting to the suction cup for applying a vacuum to the suction surface for providing suction adhesion, at least one indicator or sensor for indicating or measuring a pressure differential in the suction cup, at least one interface for communicating said measured pressure differential or a value based thereon; and a processor for controlling said vacuum adhesion system.

An advantage of this embodiment is that the user or operator of the vacuum adhesion system gains better insight in the processes that occur underneath said suction cup by being presented with the magnitude of said measured pressure differential or a value based thereon through said interface. Said interface being arranged to provide an unambiguous representation of the strength with which said suction cup is attached to an object. Said strength is preferably, presented in such a way that it may be easily understood by the operator of the vacuum adhesion system. Such representations may include the communication of a maximum weight that can be safely suspended from said suction cup in a unit of mass to the liking of the operator, such as kg.

It is noted that said processor may alternatively or additionally be denoted as a microcontroller.

In another embodiment of the vacuum adhesion system according to the invention, the processor is arranged to determine a maximum force which said suction surface can resist before detachment from said surface based on said pressure differential, wherein said interface is arranged for communicating said maximum force or value based thereon.

An advantage of this embodiment is that said processor can be programmed with a trend line equation that represents the relation between said measured pressure differential and said maximum force. Said trend line equation being determined by performing tensile strength tests under the use circumstances belonging to a particular application of the vacuum adhesion system. Said tensile strength tests are performed by pulling said suction cup from said surface under various angles in such a way that both the force of friction and the amount of said suction adhesion can be determined. The lowest results from said strength tests are plotted in a two-dimensional graph with on one axis said maximum force and on the other axis said measured pressure differential, wherein the lowest results are defined by dividing said maximum force by said pressure differential and taking a predefined percentage of the results that score the lowest. Said percentage is typically below 10%. The trend line equation can subsequently be obtained from a trend line that is drawn in said graph in such a way that it matches said lowest results as closely as possible. Because said tensile strength tests are performed under various angles it can be stated that said maximum force or value based thereon is independent from the angle under which said suction cup is loaded. This prevents the operator from having to consider the angle under which a load is applied on said suction cup when determining if an object can be safely lifted.

Said maximum force or value based thereon can be communicated in any desired way. For example, said force may be communicated by means of a maximum weight that can be suspended from said suction cup before detachment from said surface takes place. Said weight may be communicated in any desired unit of mass, such as for example kg.

In another embodiment of the vacuum adhesion system according to the invention, said processor is connected to said vacuum pump and arranged adjust a pumping capacity of said vacuum pump based on said measured pressure differential.

An advantage of this embodiment is that said processor can be arranged and in particular programmed to achieve a desired value of said measured pressure differential or value based thereon, by setting the pumping capacity of said vacuum pump. In particular the processor can be arranged to increase or decrease the pumping capacity of the vacuum pump based on said measured pressure differential, such that pressure differential may increase or decrease in accordance therewith and may be adjusted to said desired value thereof. Said desired value can be chosen by the operator by communicating it to the vacuum adhesion system through said interface. The function described here allows the vacuum adhesion system to preserve energy when said suction cup is attached to a smooth surface while increasing the performance of said suction cup on rough surfaces.

In another embodiment of the vacuum adhesion system according to the invention, the vacuum adhesion system further comprises a release valve for releasing the pressure differential in the suction cup for detaching from said surface.

An advantage of this embodiment is that said release valve allows said suction cup to detach quickly from said surface in order to increase the amount of work that can be accomplished using the vacuum adhesion system in a fixed period of time.

In another embodiment of the vacuum adhesion system according to the invention, the vacuum adhesion system comprises at least one force sensor connected to said processor for sensing a force applied onto said suction cup.

An advantage of this embodiment is that the applied force can be communicated to the operator of said vacuum adhesion system. Preferably, said processor may be arranged to deduct said applied force from a or said maximum force, which said suction surface can resist before detachment. The remaining value may be communicated to the operator through said interface. Said remaining value may show how much additional load can be applied on said suction cup before it detaches and thus provides more insight in the processes happening underneath said suction cup.

In another embodiment of the vacuum adhesion system according to the invention, the vacuum adhesion system comprises at least two, preferably at least four, of said force sensors, each force sensor being arranged to measure said force in a different direction, wherein said processor is connected to said force sensors and arranged to determine a magnitude and direction of said force applied onto said suction cup, wherein said interface is arranged for communicating said magnitude and said direction of said applied force on said suction cup.

An advantage of this embodiment is that by communicating said direction of said applied force, more insight is gained in the processes happening underneath the suction cup. Said direction and said magnitude of said applied force, otherwise known as the force vector belonging to said applied force, can be obtained by adding the force vectors belonging to the readings of said force sensors and their known directions. When one or more of said force sensors measure a force below a predetermined threshold value, which is typically set at less than 10% of the total measurement range of said force sensors, said applied force on said suction cup is assumed to be acting parallel to said suction cup. Said force vector belonging to said force applied on said suction cup is determined by projecting said force vectors belonging to forces acting on said force sensors on a plane parallel to said suction cup if they are above said threshold value. The resulting projected force vectors are added to obtain said force acting on said suction cup.

In another embodiment of the vacuum adhesion system according to the invention, said processor is connected to said at least one force sensor and arranged to compare said sensed force with said measured pressure differential or said value based thereon, wherein said vacuum adhesion system is arranged to provide a warning via said interface if said sensed force exceeds said maximum force or said value based thereon.

An advantage of this embodiment is that the vacuum adhesion system can provide warnings at an early stage, which allows the operator to act before hazardous situations arise.

In another embodiment of the vacuum adhesion system according to the invention, said processor is arranged to compare said sensed force applied on said suction cup with said measured pressure differential or value based thereon, wherein said vacuum adhesion system is arranged to reduce energy consumption if no or a small force is sensed.

An advantage of this embodiment is that the use time of the vacuum adhesion system may be increased in situations where it is not connected to a power grid. Additionally or alternatively, the operating costs of the vacuum adhesion system may be reduced due to the energy that is saved. Multiple strategies can be deployed to save energy based on said measured pressure differential or value based thereon and said sensed force applied on said suction cup. Said processor can for example adjust and in particular decrease the pumping capacity of said vacuum pump to optimize energy use. The desired pressure differential for optimizing energy use can be obtained by applying the equation: $P_d = F_s \times FoS \times T_c$. In this formula $P_d$ is the desired pressure differential, $F_s$ is the force acting on the suction cup, FoS is a programmable factor of safety and $T_c$ is the tensile strength coefficient. The tensile strength coefficient is derived from said trend line equation but in some embodiments of the vacuum adhesion system may also be replaced by an equation if said trend line equation is not a linear function. Other strategies to save energy involve reducing the energy consumption of the components contained within said interface if said sensed force on the suction cup is below said threshold value. Said processor can for example turn a display off or dim LEDs if said interface contains any.

In another embodiment of the vacuum adhesion system according to the invention, said suction surface comprises a replaceable, flexible undersole that is partly in contact with said surface for generating said force of friction with respect to said surface.

An advantage of this embodiment is that a reliable interface can be created through which a force of friction can be transmitted from said undersole to said surface. The reliability of said interface is due to the ability of said undersole to conform itself to small undulations and microstructures present on said surface. This results in a large contact area between said surface and said undersole, which gives rise to a large force of friction. A further or alternative advantage of this embodiment is that the performance characteristics of said suction surface can be altered by choosing a different embodiment of said undersole.

In another embodiment of the vacuum adhesion system according to the invention, said undersole comprises a composite material comprising a textile with a tensile strength between 1000 MPA and 6000 MPA, preferably between 1500 MPa and 4000 MPa, and a soft rubber with an elastic modulus of between 0.3 MPA and 3 MPA, preferably between 1.0 and 1.5 MPa. An advantage of this embodiment is that said composite material has a high degree of flexibility that helps it to conform to said surface but also has a high tensile strength, which allows it to resist shear forces that arise when a load is applied on said suction surface.

In another embodiment of the vacuum adhesion system according to the invention, said composite material is being chosen such that said force of friction generated by said undersole is at least equal to the amount of said suction adhesion.

An advantage of this embodiment is that this allows for said maximum force to be maximized.

In another embodiment of the vacuum adhesion system according to the invention, said suction cup further comprises a central anchor, wherein said undersole is connected to said central anchor for transmitting forces applied on the undersole to said central anchor.

An advantage of this embodiment is that the connection between the undersole and the central anchor provides a reliable means of transferring forces to the rest of the construction. The central placement of the said central anchor and its geometry enables said connection to transmit forces coming from any directions that lie in a plane parallel to said suction cup.

In another embodiment of the vacuum adhesion system according to the invention said undersole comprises a pattern of radial and circumferential grooves, wherein said grooves define parts of the undersole that are not in contact with said surface and wherein said vacuum is created for said suction adhesion to said surface, and wherein the remainder of said undersole generates said force of friction.

An advantage of this embodiment is that said undersole can be optimized for different applications by varying the amount and/or the dimensions of the grooves on said undersole. Increasing the size and/or number of grooves increases the amount of said suction adhesion and reduces said force of friction. Such an embodiment of said undersole thus would be optimized for applications in which said surface has a high coefficient of friction. Decreasing the size and/or number of grooves decreases the amount of said suction adhesion and increases said force of friction. Such an embodiment of said undersole thus would be optimized for applications in which said surface has a low coefficient of friction.

In another embodiment of the vacuum adhesion system according to the invention the number and/or size of the grooves is chosen such that said force of friction generated by said undersole is at least equal to the amount of said suction adhesion.

An advantage of this embodiment is that by finetuning the number and/or size of the grooves of said undersole said maximum force which said suction surface can resist before detachment from said surface and that is optionally communicated through said interface can be increased, which allows the operator to lift heavier loads with the vacuum adhesion system.

In another embodiment of the vacuum adhesion system according to the invention, said system module further comprises at least one battery.

An advantage of this embodiment is that by decentralizing the power supply of the vacuum adhesion system said system modules can be used without a connection to the power grid and continue to function in case of a power outage.

In another embodiment of the vacuum adhesion system according to the invention, the vacuum adhesion system comprises at least two of said system modules that are interconnected, wherein said system modules are arranged to share information and/or pumping capacity and/or electric power.

An advantage of this embodiment is that said system modules can assist each other in case of a break down. To achieve this said system modules may share information with each other about their status. If for example said vacuum pump in one of said system modules were to fail other system modules in the vacuum adhesion system are alerted and can assist by sharing their pumping capacity with the broken system module. In an example to achieve this, the other system modules may be arranged to open an electric valve that connects them to a central vacuum line. When the degree of vacuum in said central vacuum line becomes higher than the degree of vacuum in the broken system module a check valve opens inside the broken system module. The suction cup belonging to said broken system module is subsequently supplied with a vacuum that is generated by the vacuum pumps contained in the other system modules via said central vacuum line. In this way the suction cup belonging to the broken system module can be actuated by other system modules even if the broken system module is unable to control any of its intended functions. The other system modules can furthermore or alternatively supply electric power to a system module with a broken battery or power supply through a network of electric cables that interconnects said system modules. This function may also or alternatively be used to equalize the electric energy contained within said batteries of said system modules, ensuring that all said system modules in the vacuum adhesion system can be used for the same amount of time before they are drained of energy. Although said system modules are interconnected, they are still able to function independently from each other. If said central vacuum line and/or said electric cables break said modules retain enough functionality for the operator to use the vacuum adhesion system safely.

In another embodiment of the vacuum adhesion system according to the invention, one of said at least two system modules is a master system module and the other one(s) is/are (a) slave system module(s), wherein said master system module is arranged to give commands to said slave system module(s) and wherein said slave system module(s) is/are arranged to execute said commands and to provide a status update to said master system module, wherein the master system module is arranged to communicate said status update(s) via which are communicated via said interface belonging to said master system module.

An advantage of this embodiment is that said processor in said master system module is not overloaded when a large amount of said slave system modules is connected to the vacuum adhesion system. Information that is provided by the sensors contained within said slave system module(s) is processed by said processor and summarized in a status update that is send to the master system module at a regular interval. Status updates can for example contain said measured pressure differential or value based thereon and/or said maximum force or value based thereon and/or said force vector belonging to said applied force on said suction cup and/or error messages and/or information regarding said battery.

In another embodiment of the vacuum adhesion system according to the invention, said master system module is arranged to give said commands based upon said status updates and/or inputs provided through said interface belonging to said master system module.

An advantage of this embodiment is that the operator can control the entire vacuum adhesion system through said interface belonging to said master module or a smart device connected to said interface of said master module. Said master system module is furthermore arranged in such a way that it can send said commands to said slave system modules without any input from the operator. In this way the vacuum adhesion system is for example able to act upon said error messages faster in order to independently prevent hazardous situations from occurring.

In another embodiment of the vacuum adhesion system according to the invention, said commands are being chosen from a group comprising: attach, detach, assist other system module(s) and increase or decrease pumping capacity. An advantage of this embodiment is that by using a group of predetermined commands the amount of information flowing from said master module to said slave module(s) is reduced. Slave system modules can furthermore be programmed to respond appropriately to said group of commands. In this way the vacuum adhesion system responds in a predictable way to incoming information or inputs from the operator.

In another embodiment of the vacuum adhesion system according to the invention, said processor in said system module is arranged to instruct said vacuum pump(s) to start pumping when a or said force sensor(s) sense(s) that contact is made with said surface and said system module has been given said attach command.

An advantage of this embodiment is that energy is saved compared to a situation wherein said vacuum pump(s) is/are immediately engaged, i.e. start pumping, after said attach command has been provided.

In another embodiment of the vacuum adhesion system according to the invention, said processor in said system module is arranged to instruct said vacuum pump(s) to stop pumping and open said release valve when no or a small force is sensed by said force sensor(s) and said system modules have been provided with said detach command.

In this embodiment the detachment command is only executed if said force that is sensed by said force sensor(s) is equal to or smaller than a predetermined threshold value and said detach command is provided. An advantage of this embodiment is that the impact of user errors is reduced by blocking user input that can lead to dangerous situations. If for example a load is still attached to the vacuum adhesion system that is above said predetermined threshold value, the function described here prevents detachment and provides a warning message to the operator through said interface.

In another embodiment of the vacuum adhesion system according to the invention, said at least two system modules are physically connected through to each other by means of a rigid frame, wherein said processor belonging to said master system module is arranged to determine the magnitude and direction of the force acting on said rigid frame based on said status updates and said sensed forces, wherein said force acting on said rigid frame is communicated via said interface belonging to said master system module.

An advantage of this embodiment is that the communicated force vector belonging to said magnitude and said direction of said force acting on said rigid frame is easier to understand by the operator compared to an embodiment wherein said force vectors belonging to said forces applied on said suction cups are shown for each suction cup. Said force vector belonging to said force acting on said rigid frame is calculated by adding all said force vectors belonging to said forces acting on said suction cups derived from said status updates and said sensed forces. For the described function to work it is necessary to choose the coordinate system used for the force measurements in each system module in such a way that it aligns with the coordinate system of said rigid frame.

In another embodiment of the vacuum adhesion system according to the invention, said frame's dimensions are known and entered into said processor, and said processor belonging to said master system module is arranged to determine the moments acting on said rigid frame based on said status updates. Said moments on said rigid frame are communicated via said interface belonging to said master system module.

An advantage of this embodiment is that the operator gains more insight in the processes happening under said suction cups. Communicating said moments acting on said rigid frame give the operator insight in the distribution of the loads acting on said suction cups. Said moments are calculated by choosing a universal three-dimensional Cartesian coordinate system in which the positions, directions and magnitude off all said forces acting on said suction cups are plotted. Said force vector belonging to said force acting on said suction cup is subsequently decomposed into components coinciding with the axes of said universal coordinate system. To obtain the moments belonging to each component they are multiplied with the length of a lever arm, which connects the origin of said coordinate system with a line running collinear with the direction of said components, wherein the direction of said lever arm is perpendicular to said direction of said lever arm. The total moments acting around a particular axis of said universal coordinate system are finally determined by adding all said moments belonging to said components in which said component is not parallel in direction to said particular axis.

In another embodiment of the vacuum adhesion system according to the invention, said sensor for measuring a pressure differential in the suction cup is a vacuum sensor.

A vacuum sensor offers the advantage that said pressure differential may be measured relatively accurately.

In another embodiment of the vacuum adhesion system according to the invention, wherein said indicator for indicating said pressure differential in the suction cup comprises a means for determining a power consumption and pumping speed of the vacuum pump, wherein said processor is arranged to determine said pressure differential based on said power consumption and said pumping speed.

An advantage of this embodiment is that the vacuum system and electric system of the vacuum adhesion system can be simplified. Most embodiments of said vacuum pump are already equipped with sensors to measure said power consumption and said pumping speed and therefore an embodiment without a separate vacuum sensor is cheaper to produce. Said pressure differential can be determined by said processor by looking at said pumping speed and said power consumption of said vacuum pump. If there is a pressure differential present inside said suction cup, then a force will be exerted on the pumping element in said vacuum pump by said pressure differential. In this situation, when said power consumption stays the same, said pumping speed of said vacuum pump will be reduced. When said pressure differential is equalized said pumping speed will increase again. By performing tests in which said pressure differential is measured in conjunction with said power consumption and said pumping speed a relationship can be established between these parameters. To establish said relationship a combined parameter of the performance of said vacuum pump is created. Said combined performance parameter can for example be defined by dividing said power consumption with said pumping speed. The test results are subsequently plotted in a two-dimensional graph, with on one axis said combined performance parameter and on the other axis said measured pressure differential. In the vacuum adhesion system, the relationship between said combined performance parameter and said pressure differential is assumed to be equal to an equation belonging to a trend line that matches said plotted results as closely as possible.

In another embodiment of the vacuum adhesion system according to the invention, said processor is arranged to determine a force that is being applied on said suction cup based on said pressure differential.

An advantage of this embodiment is that the electric system of the vacuum adhesion system can be simplified by omitting said force sensor(s). Such an embodiment it therefore cheaper to produce than embodiments with one or more separate force sensors.

For example, said processor may be arranged to detect spikes in a two-dimensional graph, with on one axis said pressure differential and on the other axis a time-based variable that is determined using a timer function that is present in said processor. A spike in said graph may be defined as an increase or decrease in said pressure differential that cannot be explained by an increase or decrease of the desired pumping speed, said desired pumping speed being determined by said processor based on said desired pressure differential. It may therefore be assumed that said spike originates from said force applied on said suction cup, which enlarges or shrinks the sealed volume underneath said suction cup and thus creates a spike in said measured pressure differential. By looking at the magnitude and steepness of said spike compared to said desired pressure differential an estimate of the magnitude of said force applied on said suction cup can be calculated by said processor. Said steepness of said spike needs to be taken into consideration because said magnitude of said spike depends on how fast said force is applied on said suction cup in situations where leakage occurs underneath said sealing rim. A force that is slowly applied on said suction cup will yield a lower spike than a force that is applied quickly, because said spike in said pressure differential will decay over time due to leakage underneath said sealing rim. To establish said relationship between said spike and said force applied on said suction cup a combined parameter for said magnitude and said steepness of said spike is created, wherein said steepness is defined by the increase in said pressure differential divided by said time-based variable. Said combined parameter can for example be defined as the magnitude of said spike divided by said steepness of said spike. Multiple tensile strength tests are subsequently performed in which a wide range of forces coming from multiple directions are applied on said suction cup, while recording the magnitude of said forces and said combined parameter of said spike. The lowest results from said tensile strength tests are plotted in a two-dimensional graph with on one axis said force and on the other axis said combined parameter of said spike, wherein the lowest results are defined by dividing said combined parameter of said spike with said force and taking a predefined percentage of the results that score the lowest. Said percentage is typically below 10%. An equation, which is assumed to define the relationship between said combined parameter of said spike and said force, can subsequently be obtained from a trend line that is drawn in said graph in such a way that it matches said lowest results as closely as possible. Because said tensile strength tests are performed under various angles it can be stated that said force that is estimated by said processor is independent from the angle under which said suction cup is loaded. Because embodiments of the vacuum adhesion system can respond differently to a load the prediction of the force applied on said suction cup as described here needs to be calibrated each time a change is made to said vacuum adhesion system.

In another embodiment of the vacuum adhesion system according to the invention, said processor is arranged to determine if the vacuum adhesion system requires maintenance based on said power consumption, said pumping speed and said pressure differential, wherein the processor is arranged to provide a warning via said interface if said power consumption, said pumping speed or said pressure differential are outside of predefined operating boundaries.

An advantage of this embodiment is that maintenance warnings can be provided at an early stage, which allows the operator to service the system before hazardous situations arise. The function described here can for example be used to detect if the vacuum system is clogged or whether the components inside said vacuum pump have worn. In order to determine whether the vacuum adhesion system requires maintenance said processor engages said vacuum pump shortly each time after said vacuum adhesion system is switched on. Subsequently said processor gathers readings of said power consumption, said pumping speed and said measured pressure differential and compares them to predefined operating boundaries. If said readings are outside of the boundaries set for each parameter, then said processor issues a warning via said interface or may even prohibit said user or said operator from using the vacuum adhesion system in cases were said readings are far outside of said operating boundaries. Clogging of the vacuum system can be detected by looking at the first few instances after said vacuum pump is engaged and before said pressure differential is increased due to a seal which may be present at said sealing rim. A clogged vacuum system reveals itself by a small bump in said measured pressure differential that is caused by the resistance of the accumulated dust and debris against the airflow that is created by said vacuum pump. Said small bump is compared to an operating boundary that is predefined by measuring said pressure differential against said time-based variable in a vacuum adhesion system that is in optimal condition and adding an error value to said optimal pressure differential curve. Said error value represents the maximum allowable deviation from said optimal pressure differential curve and is typically defined as a small percentage below 10% of said optimal pressure differential added to a fixed error value to prevent measurement inaccuracies from triggering the warning function. To determine the amount of wear on said components in said vacuum pump it as assumed that wear causes a force of friction which needs to be overcome in order to get said pumping element moving. This force of friction increases as the amount of wear in said vacuum pump increases. During said start-up check, the power sent to said vacuum pump is slowly increased until said pumping element starts moving, which is subsequently detected by said processor. The amount of power required to get said pumping element moving is assumed to have a direct relationship with the amount of wear of said vacuum pump and is not allowed be higher than a predefined operating boundary, which is typically below 10% of the maximum power rating of said vacuum pump.

In another embodiment of the vacuum adhesion system according to the invention, said suction cup comprises a replaceable sealing rim arranged around the circumference of the suction surface or, if provided, the undersole.

An advantage of this embodiment is that the performance characteristic of said suction cup can be optimized for any application by choosing a sealing rim with the appropriate dimensions and/or material characteristics. In an embodiment that comprises said undersole the amount of wear on said sealing rim is reduced because said undersole is not subjected to any shear forces.

Said sealing rim material may be protected from being compressed beyond the elastic limit of said material by the geometry of said suction cup. This is achieved by suitably choosing the ratio between the thickness of said sealing rim in the compression direction and distance of the underside of said sealing rim to the underside of said suction cup, i.e. the suction surface, or undersole. Said ratio is preferably between 2 and 6.

In another embodiment of the vacuum adhesion system according to the invention, said sealing rim comprises a material having a shore 00 durometer of between 20 and 40.

An advantage of this embodiment is that a sealing rim with such a hardness is soft enough to conform to high roughness surfaces, while at the same time being wear resistant enough for most applications of the vacuum adhesion system.

In another embodiment of the vacuum adhesion system according to the invention, said suction cup is flexible such that it is adjustable to the shape of said surface and is attached to said system module in a movable and/or flexible manner.

An advantage of this embodiment is that the operator can conform the shape of said suction cup to the shape of a wide variety of objects by applying a force onto the circumference of said suction cup until a seal is achieved with said object. Said suction cup can attach to said object having any shape when the geometry of said shape of said object has a non-porous surface that is at least the size of said suction cup diameter and wherein the radii that describe the surface geometry of said object are larger than the minimum bend radius of said suction cup.

In particular, in this embodiment said suction cup may attach to both flat and non-flat surfaces, such as, but not limited thereto, spherical, curved, wave-like, or any other regular or unregular shaped surfaces.

In another embodiment of the vacuum adhesion system according to the invention, said suction cup comprising a flexible reinforcement element for reinforcing said suction cup or, if provided, said sealing rim.

An advantage of this embodiment is that forces can be transmitted from said suction surface, or, if provided, said undersole, upon which a pressure differential is acting, to areas toward the circumference of said suction cup which are used to form a seal with the object. Said flexible reinforcement element is also referred to as a sealing rim skeleton if a sealing rim is provided. Said reinforcement element may comprise a thin beam that oscillates around the circumference of a virtual circle. The load that said reinforcement element transmits makes sure that the circumference of said suction cup is pressed hard enough onto an object along its entire circumference to create a good seal with the object's surface. To achieve this the period of the oscillations that define the shape of said reinforcement element is chosen such that the pressure along the circumference of the said suction cup is distributed as evenly as possible.

In another embodiment of the vacuum adhesion system according to the invention, said suction cup is arranged to provide suction adhesion to a substantially flat, relatively rough surface, and is attached to said system module or any other rigid body in an inflexible and/or fixed and/or rigid manner.

An advantage of this embodiment is that forces can be transmitted from said system module or said rigid body onto said suction cup, which allows the operator to manipulate objects attached to said suction cup with more precision. Alternatively or in addition, said inflexible connection puts more pressure on said sealing rim compared to suction cups with a flexible structure. This increases the size of the surface asperities to which said sealing rim is able to conform its shape.

In another embodiment of the vacuum adhesion system according to the invention, said processor is arranged to determine if a flexible material is attached to said suction cup based on said measured pressure differential or value based thereon, wherein said vacuum adhesion system is arranged to provide a warning via said interface if said flexible material is detected.

An advantage of this embodiment is that the operator is alerted if a flexible material is attached to said suction cup. Embodiments of the vacuum adhesion system without the described function would report a value of said maximum force or value based thereon that is higher than the interface between said suction cup and said flexible material can resist, because peel forces in said flexible material break the seal between said flexible material and said sealing rim before said maximum force can be applied on said interface.

In an example embodiment to detect said flexible material, said central anchor may be provided which has in this embodiment a flat underside and said flat underside is positioned slightly above the underside of said suction surface, or, if provided, said undersole. If the material that is attached to said suction cup is flexible, said flat underside of the central anchor will seal against said flexible material, which reduces the total volume of the vacuum system compared to a situation where the seal is made at the circumference of said suction cup. Said processor is arranged to calculate the rate at which said measured pressure differential rises just after attachment of said suction cup to said surface and is therefore able to distinguish between a situation where a seal is present between said sealing rim and said surface, and the situation where said flat underside of the central anchor seals against said surface. This is because said rate at which said measured pressure differential rises is higher when the volume of said vacuum system is reduced. Said processor subsequently issues a warning through said interface when said rate at which said pressure differential rises is higher than a predetermined threshold value.

The invention also relates to a suction cup having a suction surface for attaching to a surface.

Said suction cup may for example be intended and/or arranged to form part of a vacuum adhesion system as described in any of the above described embodiments and/or having any of the above described features and/or as described with respect to any of the figures and/or according to any of the claims 1-23. Said suction cup may have any of the above or below described advantages described with respect to respective features of the suction cup.

In an embodiment of the suction cup according to the invention said suction cup comprising a replaceable, flexible undersole that is in use partly in contact with a surface for generating friction with respect to said surface.

It is noted that it is advantageous that the number of said suction cups can be varied compared to the number of said system modules. Said system module can for example be used to supply two of said suction cups with vacuum in applications that involve lifting smooth objects.

The invention also relates to a system module.

Said system module may for example be intended and/or arranged to form part of a vacuum adhesion system as described in any of the above described embodiments and/or having any of the above described features and/or as described with respect to any of the figures and/or according to any of the claims 1-23. Said system module may have any of the above or below described advantages described with respect to respective features of the system module.

In an embodiment of the system module according to the invention, said system module comprises: at least one vacuum pump connecting to a suction cup for applying a vacuum to a suction surface of the suction cup for providing suction adhesion, at least one vacuum sensor for measuring a pressure differential in the suction cup and at least one interface for communicating said measured pressure differential or a value based thereon.

It is noted that it is advantageous that the number of said system modules can be varied compared to the number of said system modules. Said suction cup can for example be supplied with vacuum by two embodiments of said system modules in applications that involve lifting very rough or porous objects.

The invention also relates to a smart suction cup for vacuum lifters that helps with lifting and moving objects, comprising a vacuum pump and a valve to regulate the pressure differential in the suction cup, which is measured by a vacuum sensor so that a prediction can be made about the maximum omnidirectional strength, which subsequently is communicated through an interface.

In an embodiment of the smart suction cup according to the invention or in a system comprising such a smart suction cup, the suction cup has a flexible undersole with a composite made from a textile with a tensile strength between 1500 MPa and 4000 MPa and a soft rubber with an elastic modulus of between 1.0 and 1.5 MPa, that makes contact with the object and prevents the suction cup from moving by generating friction, after which the emerging shear forces are transmitted by the composite to a central anchor.

Said composite preferably has a texture which consists of radial and circumferential grooves that form a network that divides the surface of the composite in contact surface and surface upon which is the pressure differential is acting, so that by changing the dimensions of the grooves the suction cup can be calibrated for an omnidirectional tensile strength under different use circumstances.

BRIEF DESCRIPTION OF THE DRAWINGS

In the drawings, which form a part of the specification,

FIG. 18 shows a bottom view of an embodiment of the system module (22).

FIG. 19 shows an exploded view of a smart suction cup consisting of the suction cup embodiment for high roughness surfaces (3*b*) in combination with an embodiment of the system module (22).

DETAILED DESCRIPTION OF THE INVENTION

Figure 1:
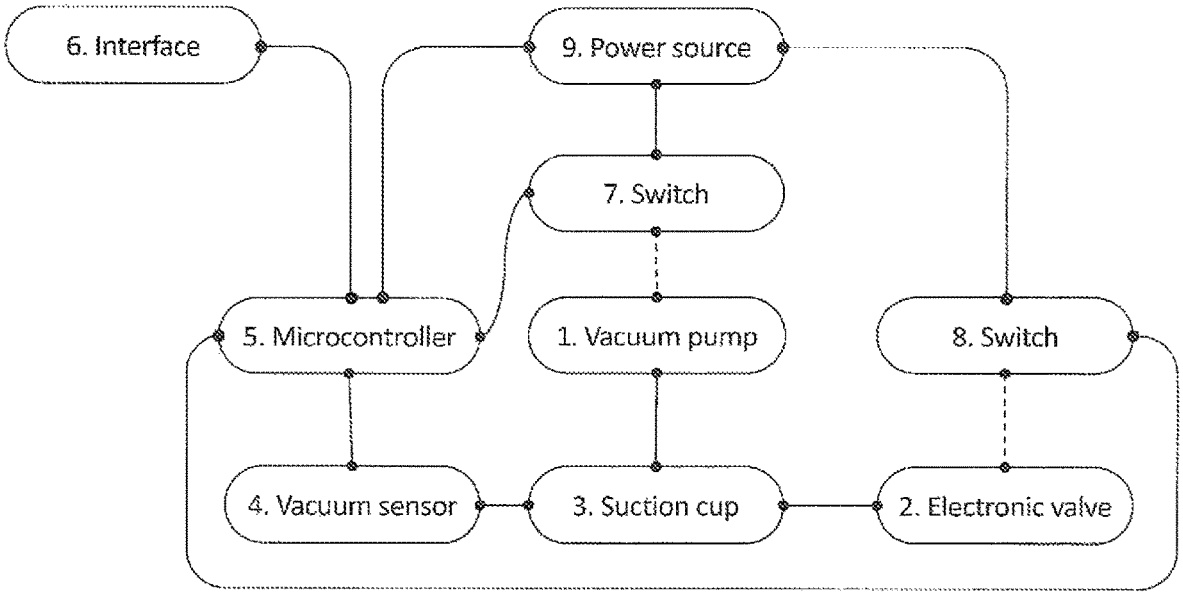
FIG. 1 shows a block diagram of the components belonging to the stand-alone embodiment of the smart suction cup.

The invention described here comprises a vacuum adhesion system consisting out of one or more smart suction cups. Two embodiments of the smart suction cup are presented. First a stand-alone embodiment of the smart suction cup is discussed with reference to FIG. 1 to FIG. 6, which is also described in U.S. Provisional Application Ser. No. 62/629,595, and which is incorporated herein by reference in its entirety. The stand-alone embodiment of the smart suction cup furthermore contains a suction cup embodiment that is optimized for surfaces with a medium amount of roughness, which can handle slight curves in the surface's geometry.

Subsequently a smart suction cup embodiment is presented in FIG. 7 to FIG. 43 that is based upon the stand-alone embodiment, but that has additional functionality. Smart suction cups in this embodiment have a modular system, which means that modules can be added or removed to change the capabilities of the vacuum adhesion system.

In addition to the suction cup embodiment presented as part of the stand-alone embodiment of the smart suction cup, two more suction cup embodiments are disclosed. One suction cup embodiment is optimized for flat and rigid surfaces with a high amount of roughness, while the second embodiment is to be used on curved and flexible surfaces, which have a low amount of roughness. To be concise, these suction cup embodiments are referred to as the suction cup embodiment for low, medium or high roughness surfaces, without mentioning their other qualities. Throughout this text references are made to FIG. 1 to FIG. 43 and the drawing references incorporated therein. The full description of the drawing references is provided in the list of drawing references. In the detailed description of the invention some qualities or characteristics of said drawing references may be omitted. In order to distinguish between components that have a similar function but that are part of a different embodiment of the vacuum adhesion system a letter is added to said drawing references. The embodiment of the vacuum adhesion system to which this letter refers to is described in the list of drawing references. If a component with multiple embodiments is referred to without an added letter this means that all embodiments of the component may be fitted to that particular embodiment of the vacuum adhesion system.

A schematic representation of the components belonging to the stand-alone embodiment of the smart suction cup can be seen in FIG. 1. The vacuum system contains a vacuum pump (1), which generates the required pressure differential to actuate the suction cup (3), an electronic valve (2) to normalize the pressure for detaching the suction cup (3), a vacuum sensor (4) to measure the pressure differential inside the system and a microcontroller (5), which is connected to the vacuum sensor (4) and an interface (6). This interface (6) displays information about the state of the smart suction cup and can be used to transmit commands to the microcontroller (5).

When commands are provided through the interface (6), they can be acted upon by the microcontroller (5) by controlling the vacuum pump (1) and the electronic valve (2). In this case the system is in 'automatic' mode and the flow of electric power through switches (7, 8) is determined by the microcontroller (5). This functionality is visualized in FIG. 1 by the dotted lines. Should the microcontroller (5) fail then the smart suction cup automatically reverts to the 'manual' mode. In 'manual' mode the suction cup is controlled by pressing switch 7 to turn the vacuum pump (1) on or off and switch 8 to activate the electronic valve (2). This connects them directly to the power source (9) which supplies electricity to the smart suction cup.

Pressing of manual switch 7 engages the vacuum pump and (1) allows the attachment of the smart suction cup onto an object. This action is detected by the microcontroller (5), which subsequently sends electric power to the vacuum pump (1), in order to generate a vacuum in the enclosed space between the suction cup (3) and an object. The resulting pressure differential compared to the atmospheric pressure pushes the suction cup (3) against the object's surface. As long as the pressure differential in the suction cup is maintained, it is possible to transmit a force to the object. On rough surfaces however, air can travel through surface asperities on the object into the enclosed space beneath the suction cup (3). In order to prevent unwanted detachment, the vacuum adhesion system can compensate for this leakage by increasing the volume of air that is evacuated from the suction cup (3) by the vacuum pump (1). Through a continuous compensation for leakage the performance of the suction cup (3) on rough surfaces is improved and the air that leaks into the suction cup (3) is pumped out directly. Nevertheless, the maximum achievable pressure in the suction cup (3) is lower on a rough surface in comparison to a smooth surface, because the vacuum pump (1) only has a limited pumping capacity.

Because the pressure differential has a strong correlation with the performance of the suction cup (3), a good indicator of the attachment strength of the suction cup is needed (3). Such an indicator needs to provide an unambiguous representation of the strength with which the suction cup (3) is attached to an object and should be presented in such a way that it is easily understood by the intended user. To achieve this, the smart suction cup contains a function that determines in real time how strong the suction cup (3) is attached to an object. The determined strength is derived from the pressure differential but is presented in the form of the maximum weight, in kg or any other preferred unit of mass, that can be suspended from the suction cup (3). This is deemed safer than communicating the pressure differential in unaltered form, because it allows the intended recipient to make a quick assessment whether the object can be lifted by comparing the approximate weight of the object with the maximum weight provided by the system.

The theoretical background for this function as well as the method to derive the equation for translating the pressure differential into the maximum allowable weight is provided. In order to be concise, the theoretical background is limited to a description of two phenomena that have the most impact on the suction cup's performance: the generation of suction adhesion and a force of friction.

Suction adhesion results from the pressure differential that is acting on the suction cup (3) and can be described by the equation $F_s=\Delta P\times A_p$. In this equation $F_s$ is the amount of suction adhesion that is being generated, $\Delta P$ is the pressure differential and $A_p$ is the surface area upon which the pressure is acting. Friction on the other hand can be defined as $F_f=\mu_s\times F_N$, in which $F_f$ is the force of friction, $\mu_s$ is the static coefficient of friction and $F_N$ the normal force. Because the normal force $F_N$ on the suction cup (3) is equal to the pressure differential $\Delta P$ multiplied by the surface upon which the pressure is acting $A_p$, both the force of friction $F_f$ and suction adhesion $F_s$ are linearly dependent on the pressure differential $\Delta P$. Although the precise value of the static coefficient of friction $\mu_s$ can only be determined experimentally, in most embodiments of the vacuum adhesion system the design of the suction cup (3) is such that the force of friction $F_f$ is at least equal to the amount of suction adhesion $F_s$ under predefined use circumstances. These are defined by use requirements, which depend on the application of the vacuum adhesion system. Use requirements can for example prescribe the temperature range in which the suction cup (3) may be used, the materials it is intended to lift or the surface contaminants it is able to handle.

After attaching a suction cup (3) to an object, tensile strength tests are performed by pulling it off from said object at various angles under the predefined use circumstances. These angles are measured compared to a line that runs tangential to the center of the suction cup (3). At an angle of 0 degrees the resistance of the suction cup (3) against the detachment force is fully defined by the force of friction $F_f$ that is being generated underneath the suction cup (3). On the other hand, when the suction cup (3) is loaded at an angle of 90 degrees its resistance against the detachment force is fully determined by the amount of suction adhesion $F_a$. For a detachment force with an angle $\propto$, in between 0 and 90 degrees, the maximum resistance of the suction cup (3) against said detachment force can be described by the equation $F_r=\sin\alpha\times F_a+\cos\alpha\times F_f$. In this equation $F_r$ is the maximum detachment force that can be resisted by the suction cup (3) at angle $\propto$.

After performing at least 100 tensile strength tests under varying use circumstances the lowest results are plotted in a graph, which typically represent the lowest 10% of the results. Said graph plots the resistance of the suction cup (3) $F_r$ against the pressure differential $\Delta P$. A trend line is subsequently drawn in the graph that matches the results as closely as possible. In the vacuum adhesion system, the equation belonging to the trend line is assumed to define the relationship between the pressure differential $\Delta P$ and the minimum detachment force $F_r$ that the suction cup (3) is able to resist. The minimum detachment force is also referred to as the tensile strength of the suction cup (3). Using the method described here and based on said trend line equation the microcontroller can convert the pressure differential $\Delta P$ to the tensile strength of the suction cup (3). The value of the tensile strength is converted into the appropriate unit of mass and may be reduced by dividing it with a programmable safety factor, before being communicated through the interface (6). Because the tensile strength of the suction cup (3) is tested at various angles, it can be stated that the communicated weight is omnidirectional. This means that the direction in which the mass is attached to the suction cup (3) is arbitrary.

Figure 3:
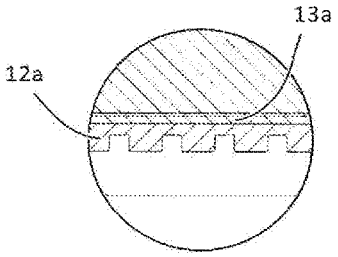
FIG. 3 shows a close-up of FIG. 2 to give more insight in the structure of the suction cup undersole (11*a*).
Figure 2:
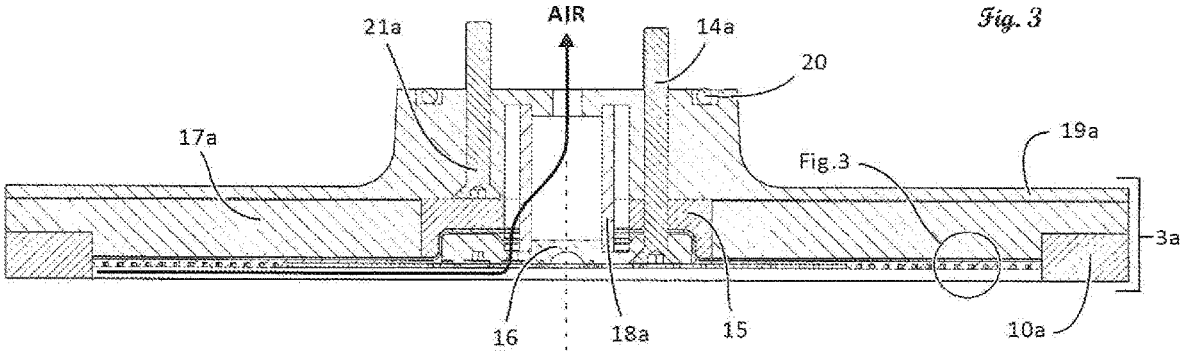
FIG. 2 shows a schematic cross section through the center of the suction cup embodiment for medium roughness surfaces (3*a*).
Figure 4:
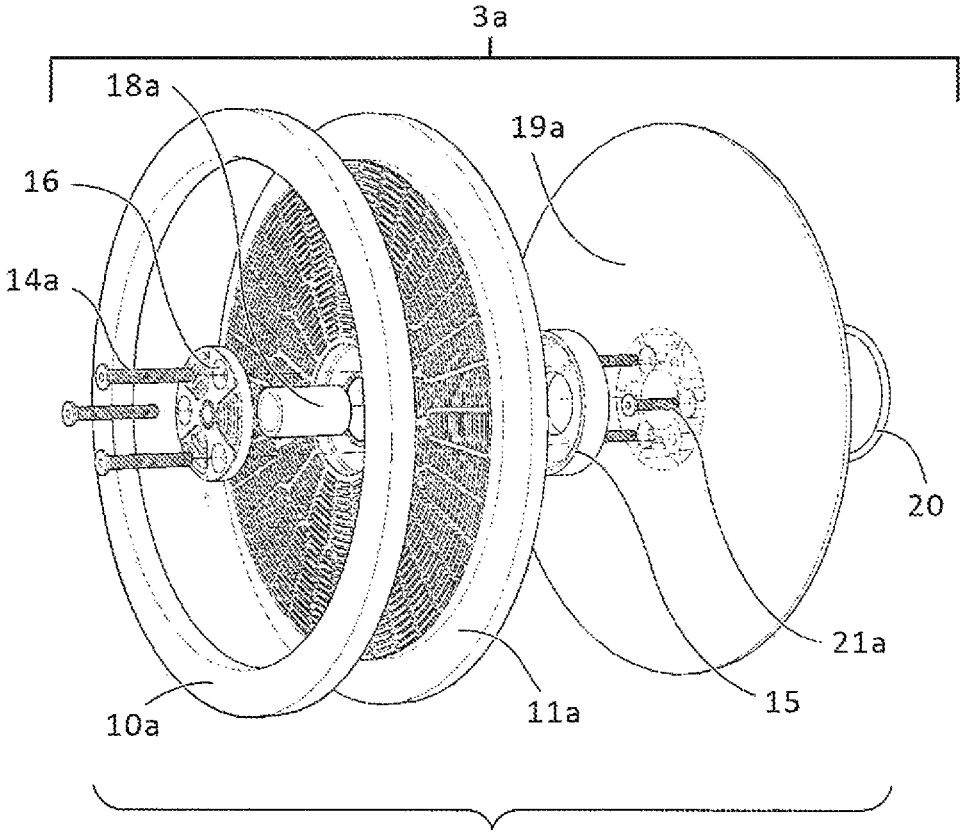
FIG. 4 shows an exploded view of the components belonging to the suction cup embodiment for medium roughness surfaces (3*a*).
Figure 5:
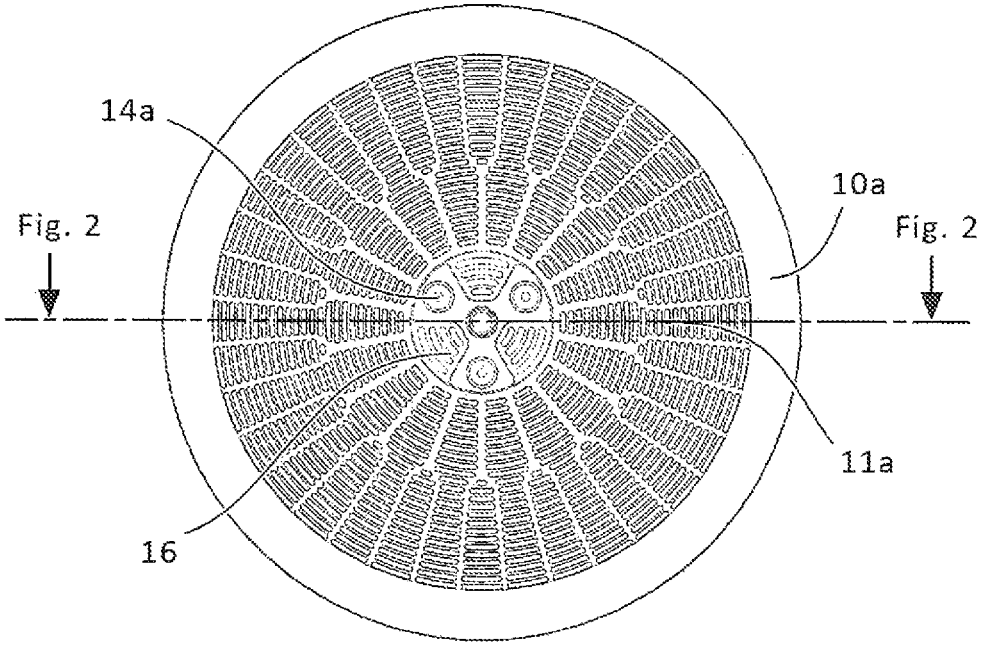
FIG. 5 shows a bottom view of the suction cup embodiment for medium roughness surfaces and contains a line that defines the cross section in FIG. 2.

The components of the suction cup embodiment for medium roughness surfaces (3*a*) can be seen in the cross section shown in FIG. 2 and the exploded view in FIG. 4. The suction cup (3*a*) has been fitted with a soft wear resistant sealing rim (10*a*) made from a closed cell foam with a shore 00 durometer of between 20 and 40. The middle of the suction cup (3*a*) consists of a composite undersole (11*a*), which contacts the object that is being lifted. The composite contains a soft rubber layer with an elastic modulus of between 1.0 and 1.5 MPa (12*a*) and a strong textile (13*a*) layer with a tensile strength of between 1500 MPa and 4000 MPa. This combination results in a very flexible composite that can resist high tensile forces. The underside of the composite undersole (11*a*) has a pattern that consists out of multiple radial and circumferential grooves as shown in FIG. 3 and FIG. 5, which form an interconnected network that distributes the pressure differential over the undersole (11*a*). When the suction cup (3*a*) is attached to a surface the areas of the undersole (11*a*) in between the grooves make contact with the object and offer resistance against shear forces by generating friction. The ratio between the area that is in contact with the object and the surface area upon which the pressure differential is acting, is crucial for achieving an omnidirectional tensile strength and can be changed to optimize the undersole (11) for different use circumstances.

In order to transmit the generated shear forces in the undersole (11*a*) to the rest of the construction, it is anchored in the middle of the suction cup by fixing the textile (13*a*) between two rigid parts as shown in FIG. 4. This anchor is subsequently fastened to the rest of the construction by three bolts (14*a*). The top part of the anchor (15) is shaped like a cup and the bottom part (16) has a raised center allowing the components to fit together. These interlocking shapes ensure a better grip on the textile (13*a*). In addition to locking the composite to the rest of the construction, the anchor also pre-tensions the undersole (11*a*). This is done by compressing a soft supporting layer (17*a*) made from a closed cell foam on top of the composite. Because the soft supporting foam layer (17*a*) can be compressed, the undersole (11*a*) has the flexibility to adjust itself to small undulations in the surface to which the suction cup (3*a*) is attached. Pre-tensioning is necessary to ensure that the normal force is distributed equally over the undersole (11*a*). Pulling up the center of the undersole lowers the amount of force that is applied on the areas towards the middle and increases the normal forces towards the edge of the undersole (11*a*). This increases the amount of friction that is being generated and makes sure that the undersole (11*a*) wears evenly, thus significantly increasing its lifetime.

To prevent polluted air from clogging up the vacuum system and damaging the vacuum pump (1), air is sucked in through several slits in the bottom part (16) of the anchor. The black arrow in FIG. 2 shows that air must travel through a central cylindrical filter in the shape of a tube (18*a*) ensuring that only clean air can reach the vacuum pump (1). Every time the suction cup (3*a*) is detached from a surface using the electronic valve (2), a blast of clean air is sent through the tubular filter (18*a*) preventing it from clogging up. When the tubular filter (18*a*) does need to be cleaned or replaced it can be accessed by removing the bolts (14*a*) that hold the bottom part (16) of the anchor.

To prevent flexible materials, such as cardboard, from blocking the suction openings, the bottom part of the anchor (16) has raised sections that form air channels, which connect with the network of grooves on the undersole (11*a*).

Figure 6:
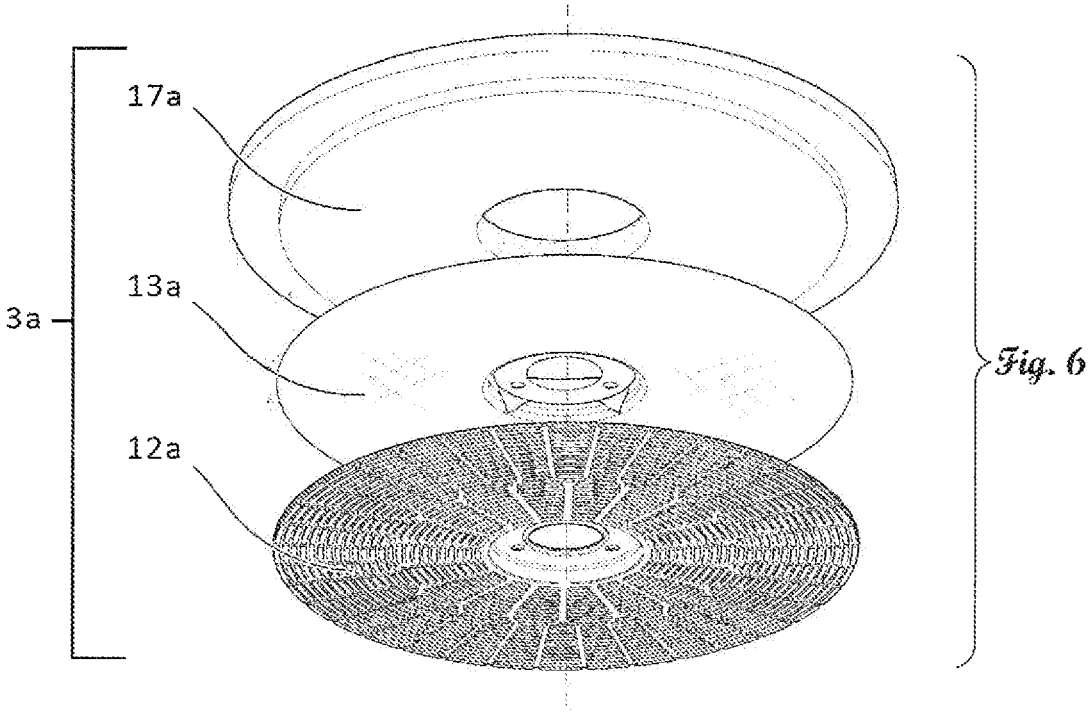
FIG. 6 shows an exploded view of the undersole of the suction cup embodiment for medium roughness surfaces (3*a*).

To make the undersole (11*a*) as durable as possible it is made from a wear-resistant rubber, such as polyurethane rubber, and consists of a single casting that comprises the soft rubber layer (11*a*), the strong textile layer (13*a*) and the soft supporting foam layer (17*a*) as shown in FIG. 6. By fusing these parts together, the chance of delamination is minimized. Furthermore, since the expansion of the foam in the closed compression mold pushes any bubbles in the soft rubber layer (12*a*) into the newly formed soft supporting foam layer (17) the formation of air-bubbles in the composite is avoided.

The undersole (11*a*) is attached to a skeleton (19*a*) using a double-sided adhesive to prevent it from shifting. This skeleton (19*a*) consists out of a thin plate with a raised center section. The raised section has a groove into which an O-ring (20) is placed so that an airtight connection can be created. This O-ring (20) is compressed using a bolt (21*a*) connection that also serves as a means of securing the suction cup skeleton (19*a*) to the rest of the construction. Because the thin section of the skeleton (19*a*) is somewhat flexible, the suction cup (3*a*) can adjust its shape to slightly curved surfaces, increasing the number of objects that can be lifted with the suction cup (3*a*).

Figure 7:
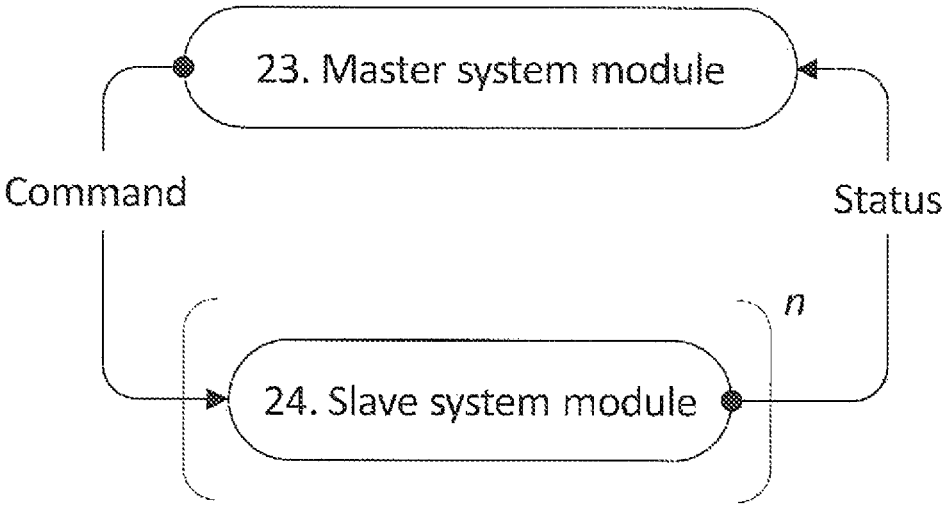
FIG. 7 shows a block diagram representing the communication between master and slave system modules in the modular embodiment of the smart suction cup.
Figure 8:
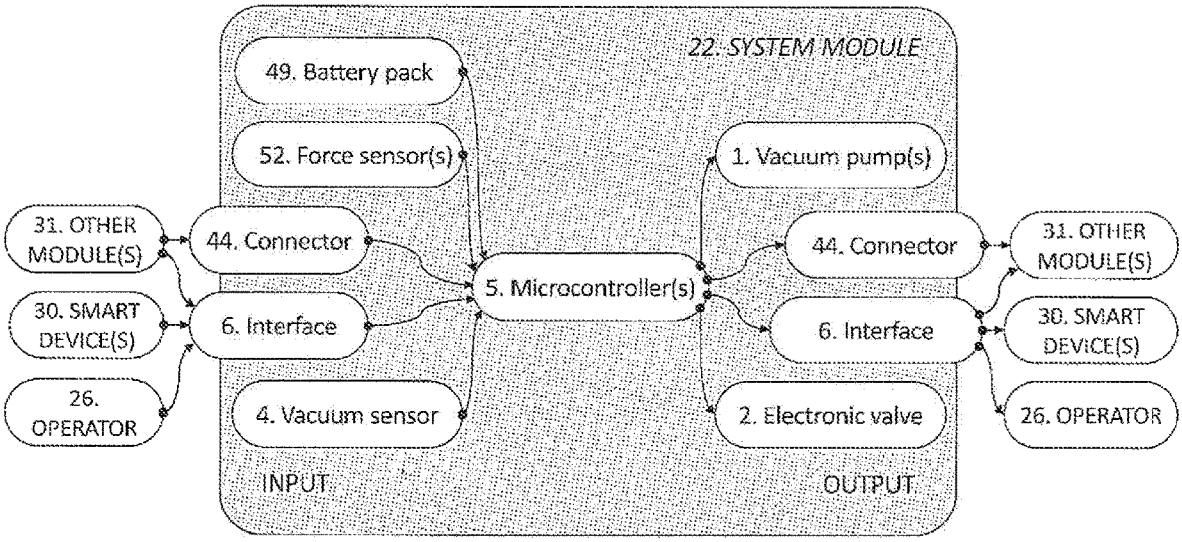
FIG. 8 shows an input/output model of the information flow within a system module (22) of the modular embodiment of the smart suction cup, which is also referred to as the information system of said system module (22).
Figure 9:
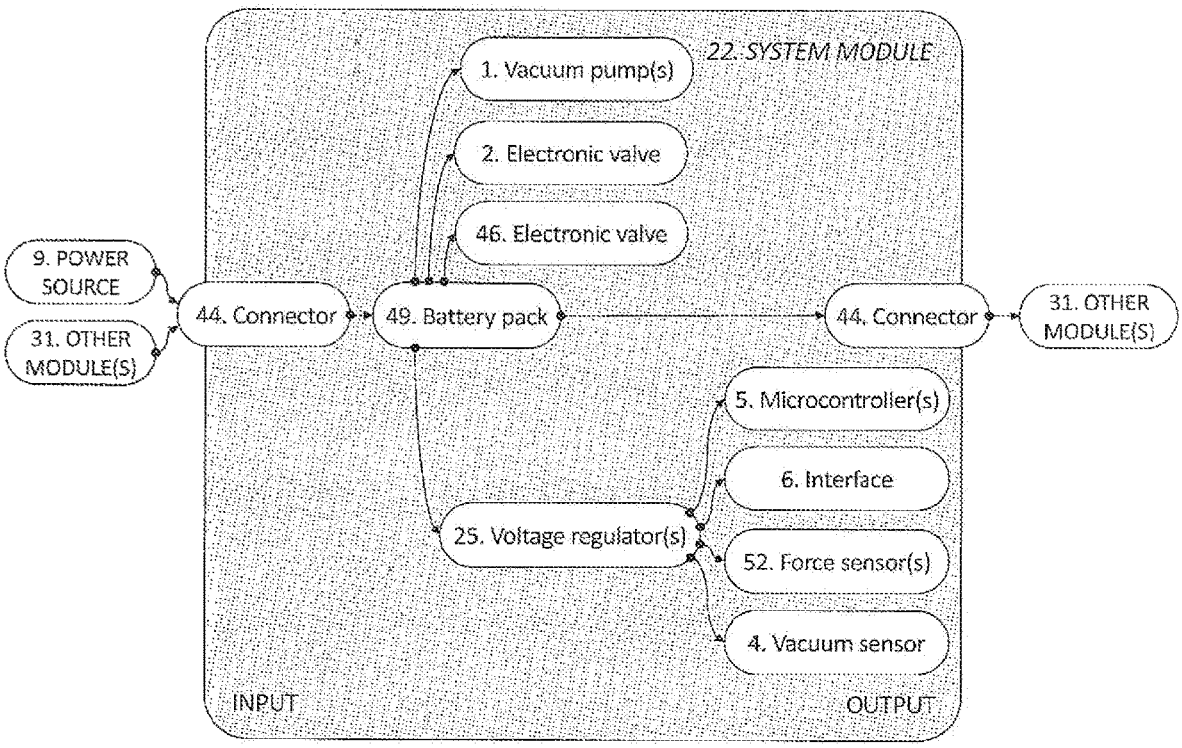
FIG. 9 shows an input/output model of the flow of electric power within a system module (22) of the modular embodiment of the smart suction cup, which is also referred to as the electrical system of said system module (22).
Figure 10:
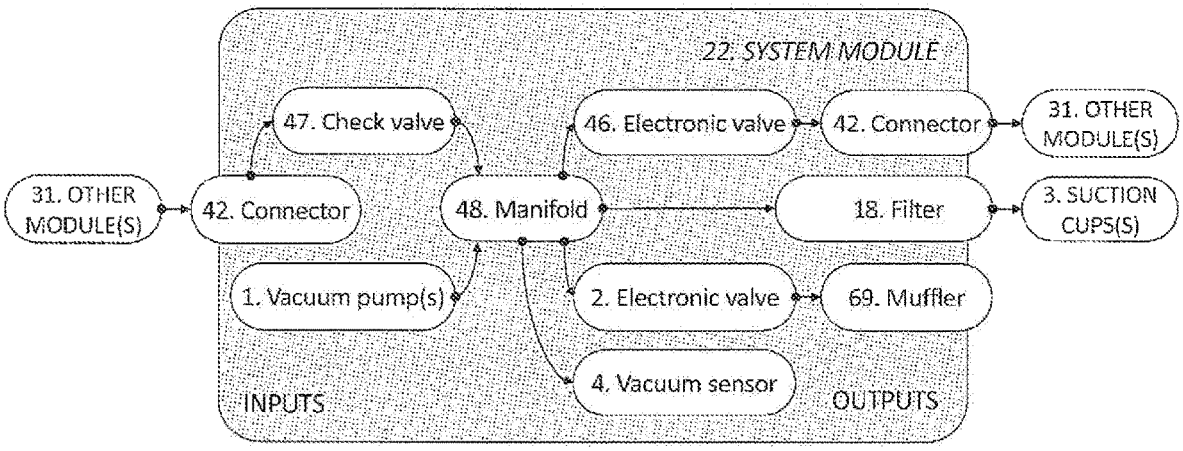
FIG. 10 shows an input/output model of the vacuum system within a system module (22) of the modular embodiment of the smart suction cup.
Figure 11:
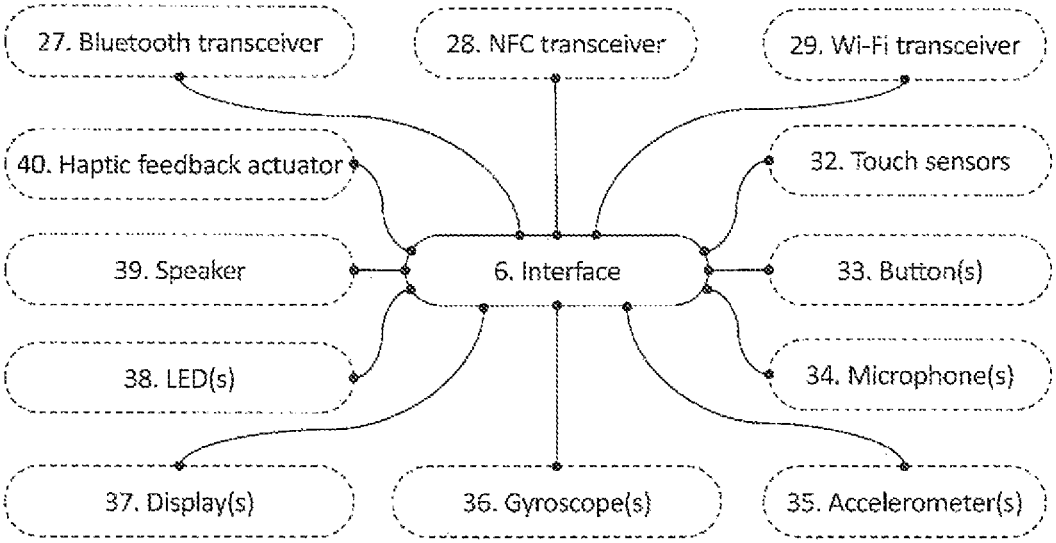
FIG. 11 shows a block diagram of the components belonging to the interface (6).
Figure 12:
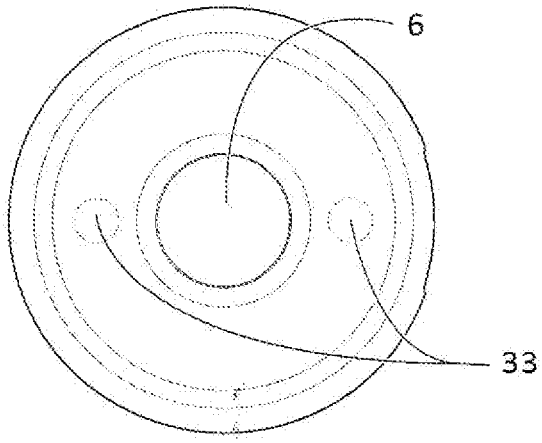
FIG. 12 shows a top view of an embodiment of the master system module (22).

The system design of the modular embodiment of the smart suction cup is shown in FIG. 8, FIG. 9 and FIG. 10. FIG. 8 illustrates how information flows through the smart suction cup, while FIG. 9 and FIG. 10 do the same for the flow of electric power and vacuum. The system design of the modular embodiment of the smart suction cup is derived from the decentralized nerve network that controls the suction cups on the arms of an octopus. These suction cups can function independently from each other but communicate summarized information with the central nervous system of the animal. The goal of this structure is to prevent the higher motor centers in the brain of the animal from becoming overloaded with sensory information. Higher motor centers only provide general commands such as 'attach' or 'detach', which are subsequently executed by the lower motor centers. This structure is mimicked in the modular embodiment of the vacuum adhesion system by dividing the system modules (22) into two categories. Master system modules (23) form the higher motor centers of the system and provide commands for the slave system modules (24), which represent the lower motor centers. Slave system modules (24) subsequently respond with summarized information about their status. This hierarchical system is depicted in FIG. 7. Master system modules (23) typically have a higher degree of redundancy than slave system modules (24). They can for example have redundant microcontrollers (5) and voltage regulators (25) to make sure that the control over the system is not lost when one of these components fails. Master system modules (23) also feature a more elaborate interface (6) through which an operator (26) can control the vacuum adhesion system and receive information about the system's status. FIG. 11 shows an overview of all components that can be part of the interface (6). Depending on the use requirements for the vacuum adhesion system these can be present is some embodiments of the smart suction cup while being omitted from others. An interface (6) can for example be equipped with a Bluetooth transceiver (27), an NFC transceiver (28) and a Wi-Fi transceiver (29) in order to communicate with nearby smart devices (30). However, these wireless communication transceivers (27, 28, 29) can also be used as a secondary method of communicating with other system modules (22). This feature improves reliability if something goes wrong with the hard-wired connections of the vacuum adhesion system. The other components that can be incorporated into the interface (6) are used to communicate with the operator (26). For acquiring inputs from the operator (26) the system may contain touch sensors (32) and buttons (33) to record physical interactions, a microphone (34) to receive voice commands and accelerometers (35) or gyroscopes (36) to receive information about the device's movement and orientation. Information can be sent to the operator (26) visually using a display (37) or LEDs (38), audibly with the help of speakers (39) and through haptic feedback using haptic feedback actuators (40).

Figure 15:
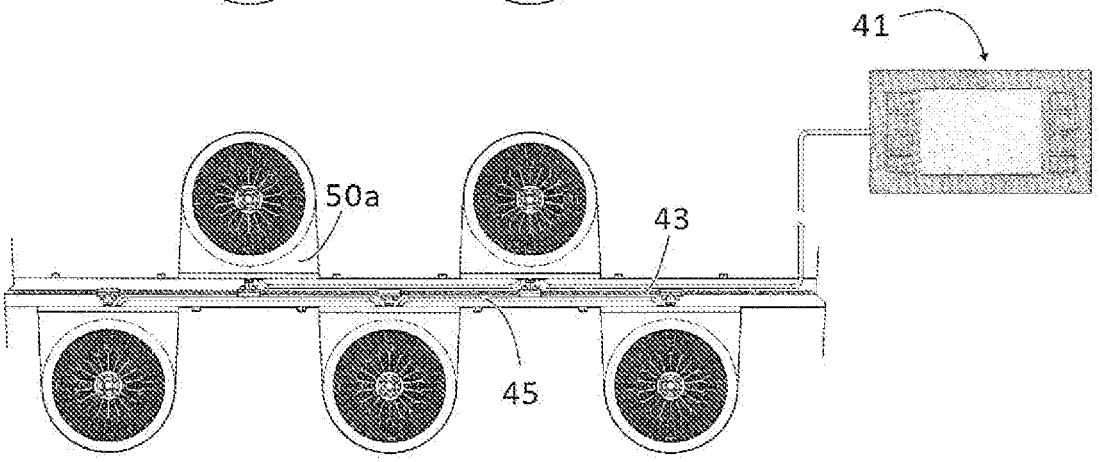
FIG. 15 shows a bottom view of an embodiment of the vacuum adhesion system containing multiple interconnected smart suction cups.
Figure 16:
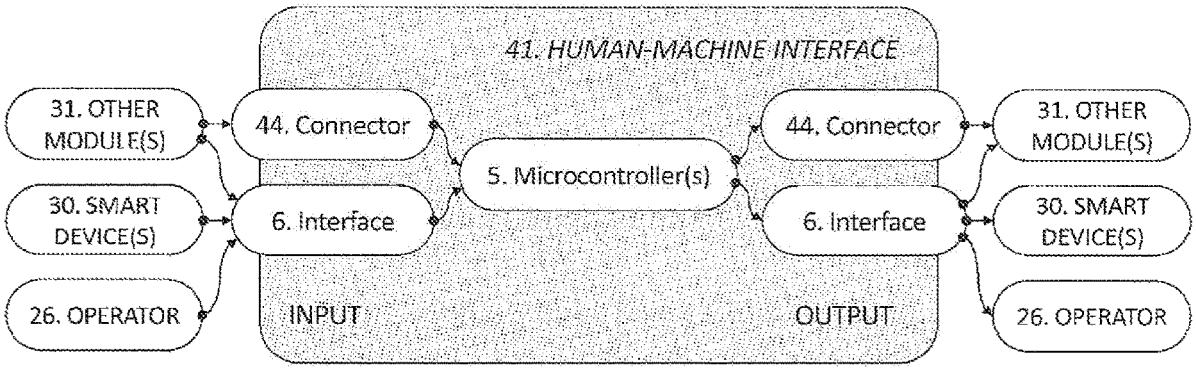
FIG. 16 shows an input/output model of the information flow of a master system module in the form of a human-machine interface (41).
Figure 17:
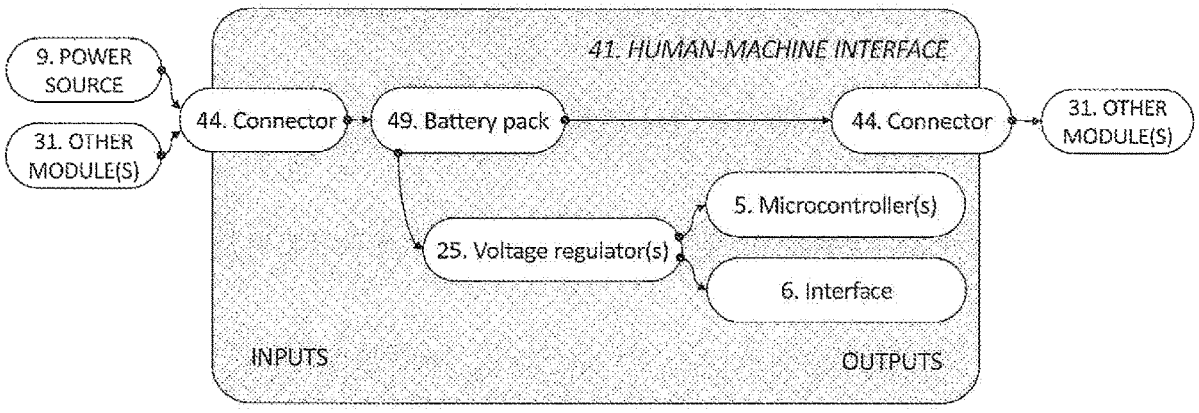
FIG. 17 shows an input/output model of the flow of electric power within a master system module (23) in the form of a human machine interface (41).
Figure 20:
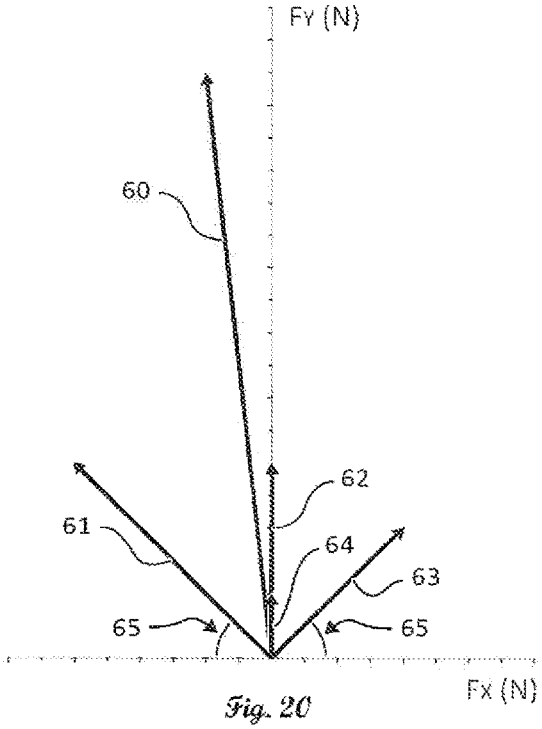
FIG. 20 shows a graph with two axes, Fy and Fx, in which the force vectors belong to the forces acting on four force sensors (61, 62, 63, 64) and the force vector belonging to the force applied on the suction cup (60) are plotted.
Figure 21:
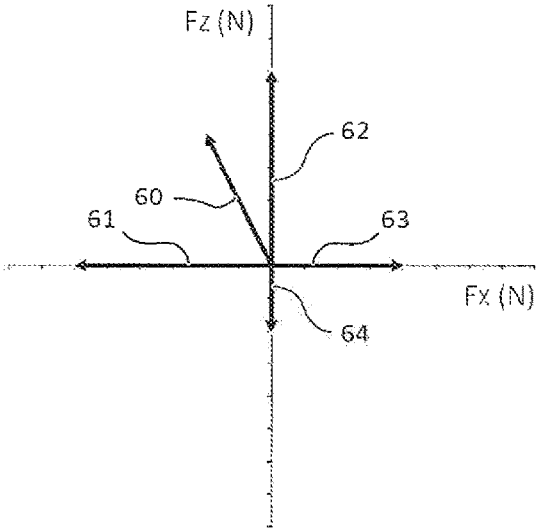
FIG. 21 shows a graph with two axes, Fz and Fx, in which the force vectors belong to the forces acting on the force sensors (61, 62, 63, 64) and the vector belonging to the force applied on the suction cup (60) are plotted.

Although master system modules (23) can be fully functional system modules (22) by themselves in some embodiments of the vacuum adhesion system, they can also be connected to the vacuum adhesion system in the form of a human-machine interface (41), an example of which is depicted in FIG. 15. In this embodiment of the master system module all vacuum related components are omitted from the system module as shown in the FIG. 16 and FIG. 17.

Figure 13:
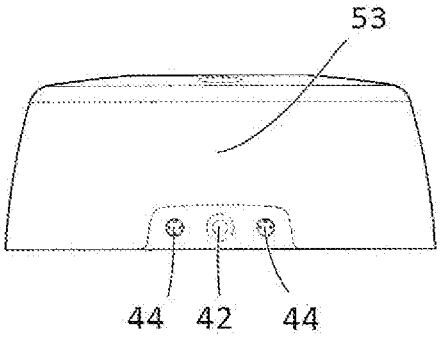
FIG. 13 shows a side view of an embodiment of the master system module (22).

System modules (22) are connected to each other using a set of connectors, which can be seen in FIG. 13. The pneumatic connector (42) in the middle of the system module (22) can receive a pneumatic tube that branches from a central vacuum line system (43). The central vacuum line system (43) subsequently connects with other modules (31) in such a way that a sealed volume is created, which can sustain a vacuum. Electric power and information are sent through a combined connector (44), which handles both electric power and data transmissions. The internal wiring of a system module (22) is such that master system modules (23) and slave system modules (24) can be connected to each other in a random order by attaching electric cables (45) to one or more combined connectors (42). However, each string of modules may only contain one master system module (23) to prevent that commands from two different master system modules (23) contradict each other. In FIG. 15 two examples of a vacuum adhesion system are provided. Two of the slave system modules (24) are connected to a fully functional master system module (23), while the other two slave system modules (23) are connected to a master system module embodiment in the form of a human-machine interface (41). Because the system modules (22) share a central vacuum line system (43), they can assist each other in case of a breakdown. If for example the vacuum pump (1) in one of the system modules (22) fails, then the master system module (23) receives a status update containing a warning about the defect. Based on this warning the master system module (23) instructs other system modules (22) to increase the pumping speed of their vacuum pump (1) and to open the electronic valve (46) between the module (22) and the central vacuum line (43). As soon as the degree of vacuum in this line (43) becomes higher than within the broken module (22) a check valve (47) opens and the vacuum underneath the suction cup (3) is restored when air is evacuated through a connecting manifold (48) towards the other modules (31). In this way broken system modules (22) can be controlled even if they experience a total loss of power.

In comparison to the stand-alone embodiment of the smart suction cup, the modular embodiment of the smart suction cup has several extra components. One of these additional components is a battery pack (49) that is contained within each system module (22). This addition makes sure that the vacuum adhesion system can be used without a direct connection to the power grid. Decentralizing the power supply of the vacuum adhesion system furthermore increases its reliability and ensures that system modules (22), which get separated from the network, are able to power themselves.

Figure 14:
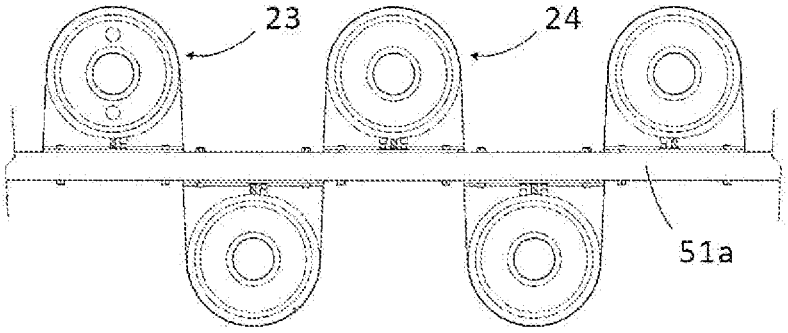
FIG. 14 shows a top view of an embodiment of the vacuum adhesion system containing multiple interconnected smart suction cups.

System modules (22) can be physically connected to each other as illustrated in FIG. 14 and FIG. 15. A bracket (50) is placed underneath the system module (22), which allows it to be attached to a frame (51*a*). The electric cables (45) and central vacuum line system (43) are placed underneath said frame (51*a*) and can be protected by for example cable trunking. By connecting multiple system modules (22) the total lifting capacity of the vacuum adhesion system is increased, which expands the number of applications for the vacuum adhesion system. However, increasing the lifting capacity of the system also brings along larger risks, since the objects that can be lifted are heavier. To address these risks the system modules (22) in the modular embodiment of the vacuum adhesion system contain force sensors (52). In an embodiment of the system module (22) as shown in FIG. 18 the force sensors (52) are placed within the circumference of the enclosure (53). However, in other embodiments of the smart suction cup the force sensors (52) may also be placed on a separate rigid body that connects to the suction cup (3) in the same way as the system module (22) seen in FIG. 19.

The force sensors (52), which measure a force in a single direction, are positioned in such a way that a virtual cone can make contact with all force sensors (52). In addition, the placement of the force sensors (52) is such that the directions of the measured forces are perpendicular to the surface of the cone. Finally, the force sensors (52) need to be spaced in such a way that there is an equal amount of distance in between them.

When the suction cup (3) is attached to a fixed surface a force that is applied on the bracket (50) is transmitted fully to the force sensors (52) using mounting blocks (54). These mounting blocks (54) can swivel around an axis perpendicular to the mounting bracket in order for them to self-align with the force sensors (52). To achieve this each mounting block (54) has a beveled surface that is perpendicular to the measurement direction of the force sensors (52). In some of the embodiments of the smart suction cup a soft elastic foot (55) is present on the contact plane of the mounting block and the force sensor as shown in FIG. 19. This soft elastic foot (55) makes sure that the loads which are applied on the force sensor (52) are evenly distributed.

The construction disclosed here allows the microcontroller or any other suitable processor (5) to reconstruct the magnitude and direction of the force acting on the suction cup (3) by combining the discrete measurements of all force sensors (52) and their known measurement directions. The calculation that is made by the microcontroller (5) in an embodiment of the system module (22) with four force sensors (56, 57, 58, 59) can be described with the formula: $\vec{S}=\vec{F}_1+\vec{F}_2+\vec{F}_3+\vec{F}_4$. In this formula, which is visualized in FIG. 20 and FIG. 21, $\vec{S}$ is the force vector (60) belonging to the force acting on the suction cup and $\vec{F}_1$ to $\vec{F}_4$ are the force vectors (61, 62, 63, 64) belonging to the forces acting on the four force sensors (56, 57, 58, 59). As long as the force sensors (52) are placed according to the description provided, the same calculation method can also be employed if at least two or more force sensors (52) are used.

Figure 22:
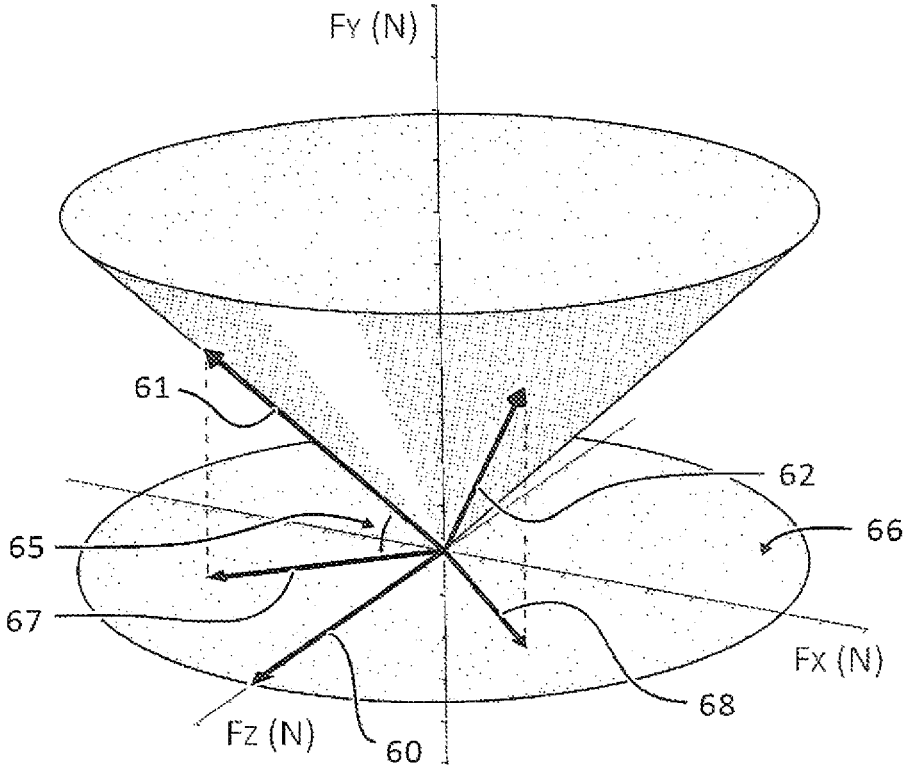
FIG. 22 shows a graph with three axes, Fy, Fz, and Fx, in which the force vectors belong to the forces acting on two force sensors (61, 62), two force vectors belonging to the projected force vectors (67, 68) and the force vector belonging to the force applied on the suction cup (60) are plotted.

Normally the three-dimensional measurement range of the force sensor array (56, 57, 58, 59) as shown in FIG. 22 is limited by the angle of the cone (65) that controls their placement and the maximum force they can measure. However, another two-dimensional plane (66) can be added to the measurement range of the force sensors array (56, 57, 58, 59). The addition of this plane (66) enables the force sensor array (56, 57, 58, 59) to detect forces parallel to the suction cup (3) by checking whether one or more of the force sensors (56, 57, 58, 59) report a force that is below a very low predetermined threshold value. If this is the case the force vector acting on the suction cup (60) is assumed to lie in the parallel measurement plane (66). In the scenario illustrated in FIG. 22 the force vector belonging to force sensor 1 and 2 (61, 62) are equal in direction and magnitude, while the magnitude of the force vectors belonging to force sensor 3 and 4 (63, 64) are below the threshold value. In this situation the force vector belonging to the force acting on the suction cup (60) is determined by projecting the force vectors from the force sensors (61, 62) onto the parallel measurement plane (66). The resulting projected force vectors (67, 68) are subsequently added to acquire the force vector belonging to the force acting on the suction cup (60). This same calculation method can be applied in embodiments of the smart suction cup with a different number of force sensors (52). In a situation where only one force vector is projected onto the parallel measurement plane (66) the last step of the calculation is skipped, since the force vector acting on the suction cup (60) is equal to the remaining projected force vector.

The threshold value for the force sensors (52) is chosen such that any preload and inaccuracy in the force measurement is compensated and the microcontroller (5) can make a good assessment whether there is a load applied on the force sensor (52). Such a threshold value is typically below 10% of the total measurement range of the force sensor (52).

Figure 23:
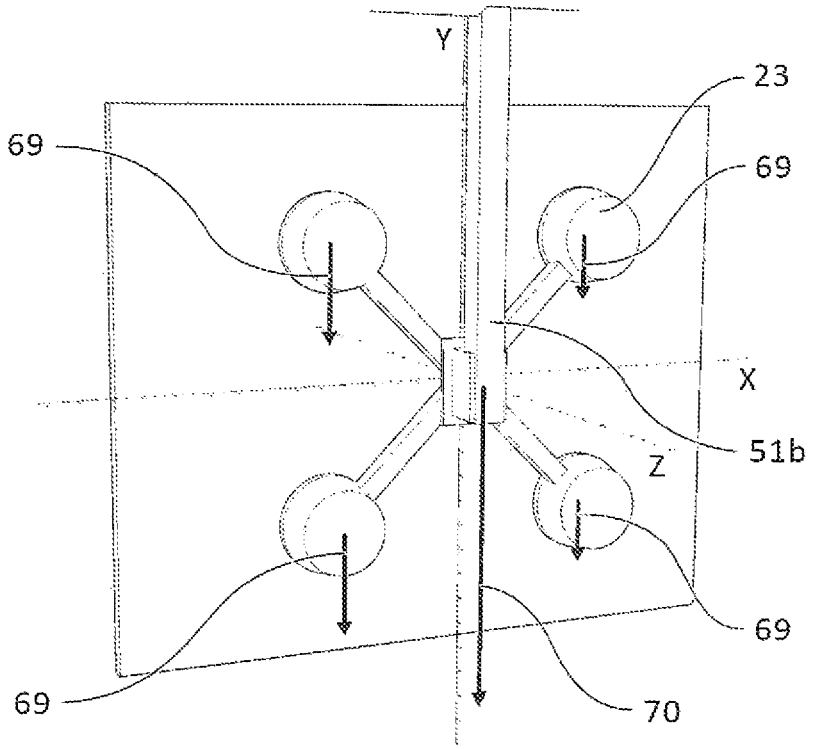
FIG. 23 shows a graph with three axes, x, y and z, in combination with a schematic drawing of an embodiment of the suction adhesion system with four smart suction cups, showing the force vectors belonging to forces applied on each suction cup (69) and the force vector belonging to the total force acting on the frame (70).
Figure 24:
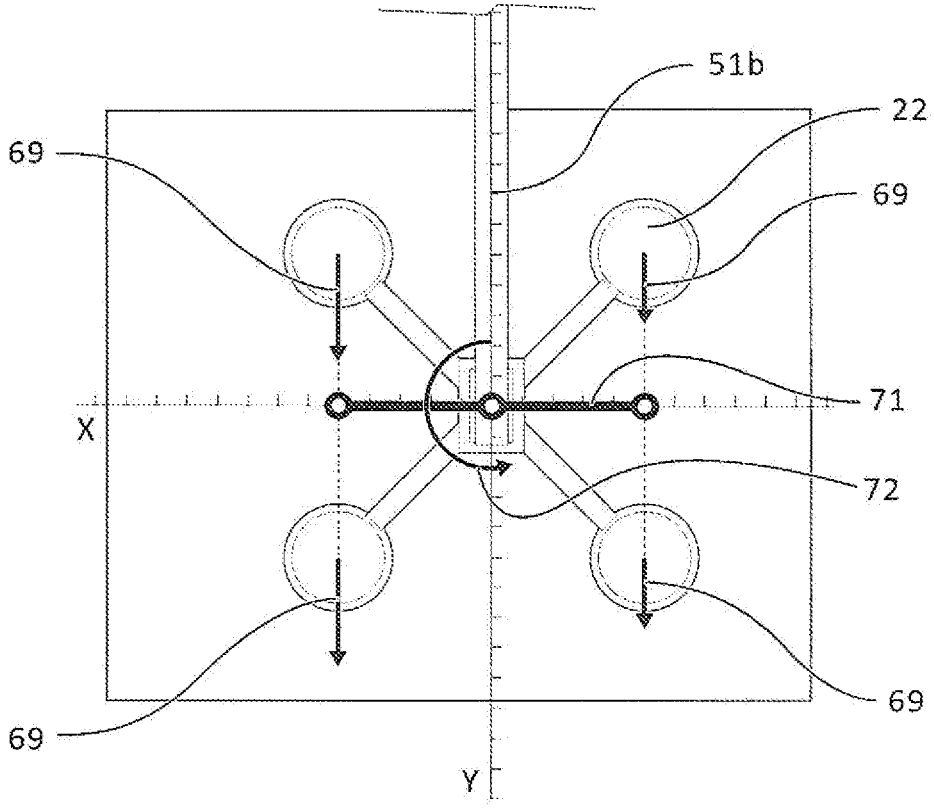
FIG. 24 shows a graph with two axes, x and z, in combination with a schematic drawing of an embodiment of the suction adhesion system with four smart suction cups, showing the force vectors belonging to forces applied on each suction cup (69) and the moment acting around the z-axis of the frame (51*b*).
Figure 25:
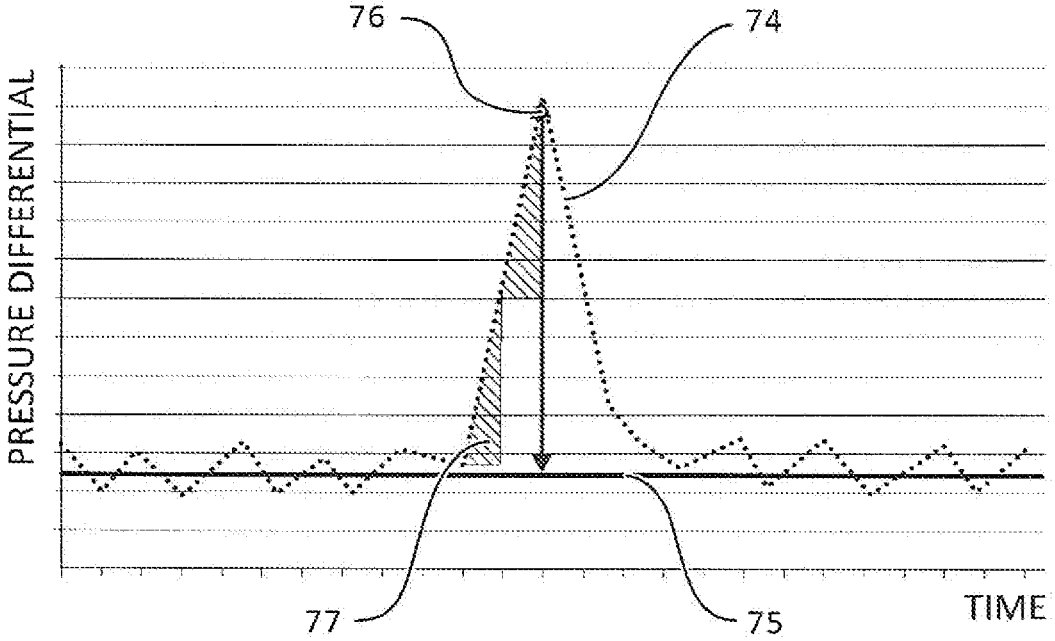
FIG. 25 shows a graph with two axes, time and pressure differential, in which a value of the desired pressure differential (75), and pressure differential measurements of a smart suction cup upon which a force is applied.

The ability of system modules (21) to sense the magnitude and direction of a load in combination with the function to predict tensile strength of the suction cup (3) enables new functionality that is not present in existing vacuum adhesion systems. To describe these new functions a scenario is provided here of the normal use of an embodiment of the vacuum adhesion system containing four smart suction cups, which are physically connected via a rigid frame and have a central vacuum line system (43) as shown in FIG. 23 and FIG. 24. This system is controlled by an operator (26) that wants to move a heavy object using the vacuum adhesion system. The scenario starts in a state where the vacuum adhesion system is detached from the object.

To attach the vacuum adhesion system to the object, the operator (26) provides an 'attach' command to the master system module (23) through the interface (6), which is subsequently transmitted to the slave system modules (24) as depicted in FIG. 7. This causes the microcontroller (5) to start monitoring the force readings provided by the force sensors (52). The operator then applies a force to the frame (51*b*) to bring the suction cups (3) in contact with the object. This force can be applied by hand or can be provided by an actuator that is controlled by the operator (26).

The force sensors (52) detect when the contact is made between one of the suction cups (3) and the object. Subsequently, the microcontroller (5), which monitors the force sensors (52) engages the vacuum pump (1) in order to create a pressure differential in the suction cup (3). In the first instance, the vacuum pump (1) will be ordered to pump at its maximum capacity in order to establish the maximum pressure differential that can be achieved underneath the suction cup (3). This maximum pressure differential is recorded by the vacuum sensor (4) and translated by the microcontroller (5) to the tensile strength of the suction cup (3). The maximum tensile strength is subsequently communicated with the master system module (23) and to the operator (25) through the interface (6) of the slave system module (24). A more detailed overview of the maximum tensile strength for the total vacuum adhesion system can be provided through the interface (6) of the master system module (23) and any connected smart devices (30), such as a smartphone or a tablet. This overview can for example show the maximum predicted strength of all connected smart suction cups, but also other information about the status of the vacuum adhesion system, such as battery levels and service messages. The operator (26) is thus able to see which smart suction cups (3) create the most amount of adhesion and which suction cups (3) have the lowest performance. In most embodiments of the vacuum adhesion system, the maximum tensile strength that is communicated with the operator (25) is divided by the microcontroller (3) with a programmable safety factor. The value of this factor of safety is typically between 1.3 and 3. For dangerous applications the safety factor is set higher compared to applications which impose less risks.

After the maximum tensile strength has been established the vacuum adhesion system enters the attached state. In this state the microcontroller (5) monitors the load that is exerted on the suction cups (3) and adjusts the pressure differential accordingly, by increasing or decreasing the pumping capacity of the vacuum pump (1). This is done in such a way that energy is conserved when there is no load attached, and the pressure differential is automatically increased to brace the vacuum adhesion system against high detachment forces. The desired pressure differential is calculated by the microcontroller (5) by multiplying the detected load with the programmable safety factor and a tensile strength coefficient. Said calculation can be described using the formula: $P_d = F_b \times FoS \times T_c$. In this formula $P_d$ is the desired pressure differential, $F_b$ is the force acting on the suction cup (60), FoS is the programmable factor of safety and $T_c$ is the tensile strength coefficient. The tensile strength coefficient is derived from the trend line equation but in some embodiments of the vacuum adhesion system may also be replaced by an equation if the trend line equation is not a linear function. If the desired pressure differential becomes greater than the maximum pressure differential, the system module (22) issues a warning through its interface (6) to the operator (25). If the system module (22) is a slave system module (24), a status warning is subsequently sent to the master system module (23), which repeats the warning on its own interface (6). The master system module (23) can furthermore command system modules (22) with spare pumping capacity to assist the overloaded system module (22).

When the operator (26) lifts the object using the vacuum adhesion system, said system can monitor the force on each individual suction cup (3) and can therefore provide insight in dynamic forces and moments that occur during lifting as shown in FIG. 23 and FIG. 24. In outdoor applications, wind gusts for example can result in peak loads on several suction cups. These can be reported to the operator (26) via the interface (6) which may urge the operator (26) to abort the lifting operation to prevent an accident from happening. FIG. 23 shows an example of how such an overview may be provided to the operator (26). The forces vectors belonging to the forces applied on each of the four suction cups (69) are shown in conjunction with a total force vector (70) that acts on the frame (51*b*). The total force vector (70) is determined by adding all force vectors belonging to the forces applied on the suction cups (69). A prerequisite for this calculation is that the coordinate system belonging to the forces acting on the suction cups are aligned with the coordinate system of the frame. In the same way the moments acting on the frame (51*b*) can be calculated. However, to be able to accomplish this the processor needs to know the dimensions of the frame (51*b*) in order to be able to determine the length of the lever arms (71) belonging to the moments provided by the forces acting on the suction cups (69). FIG. 24 shows how the force vectors shown in FIG. 23 can be used to determine the moment acting around the z-axis of the frame (72). To achieve this, the force vectors (69) are decomposed into their x, y and z components. In the example shown in FIG. 23 the force vectors (69) only contain an x component and are therefore equal to the force vectors (69) shown in FIG. 24. The force vectors with a direction (69) that fit in a plane perpendicular to the z-axis are subsequently multiplied with the lever arm (71) to obtain the moments acting on the frame (51*b*), which are caused by the forces acting on each suction cup (3). By adding said moments, the total moment acting around the z-axis of the frame (51*b*) can be calculated. These calculations can also be performed to obtain the moments acting around the other axes of the frame. It is furthermore possible to apply the calculations in vacuum adhesion system embodiments with a different number of suction cups (3).

After the lifting operation is completed the operator (26) can detach the vacuum adhesion system from the object by submitting a 'detach' command to the interface (6) of the master system module (23). This command is transmitted to the slave system modules (24). All system modules (22) subsequently check if the object has indeed been put down. For the vacuum adhesion system this is the case when none of the system modules (22) detect a significant load. If a load is still detected by one of the system modules (22) a status warning is sent to the master system module (23), which halts the detachment procedure. Both the affected system module (22) and if applicable the master system module (23) send out a warning to the operator (26) through their respective interfaces (6). The operator (26) can choose to ignore the warning by issuing another detach command or reposition the object until all system modules (22) report that no load is attached. The actual detachment of the vacuum adhesion system takes place by opening all electronic valves (2, 46) in the system. In this way all suction cups (3) are connected through the central vacuum line system (43) and form a single volume of air. When the electronic valves open (2), air is sucked in through pneumatic mufflers (73), which provide a small resistance to the air flowing in. Because of this small resistance, the pressure differential in the whole system drops at a controlled rate, which ensures that all suction cups (3) detach at the same time.

In order for the vacuum adhesion system to be suitable for low cost applications, a number of functions are disclosed here that reduce the costs of said system. These functions allow sensors to be omitted from the vacuum adhesion system by programming the processor (5) in such a way that it can determine the required sensor inputs from other system parameters.

In some embodiments of the vacuum adhesion system the processor (5) is for example arranged to determine the pressure differential based on the power consumption and pumping speed of the vacuum pump (1). An advantage of this embodiment is that the vacuum system and electrical system of the vacuum adhesion system can be simplified. Most embodiments of the vacuum pump (1) are already equipped to provide said power consumption and said pumping speed and therefore an embodiment without a separate vacuum sensor (4) is cheaper to produce. If there is a pressure differential present inside the suction cup (3), then a force will be exerted on the pumping element in the vacuum pump (1) by the pressure differential. In this situation, assuming that the power consumption stays the same, the pumping speed of the vacuum pump (1) will be reduced. When the pressure differential is equalized, the pumping speed increases again. By performing tests in which the pressure differential is measured in conjunction with the power consumption and the pumping speed, a relationship can be established between these parameters. To establish said relationship a combined parameter of the performance of the vacuum pump (1) is created. The combined performance parameter can for example be defined by dividing the power consumption with the pumping speed. The test results are subsequently plotted in a two-dimensional graph, with on one axis the combined performance parameter and on the other axis the measured pressure differential. In the vacuum adhesion system, the relationship between the combined performance parameter and the pressure differential is assumed to be equal to an equation belonging to a trend line that matches the plotted results as closely as possible.

In another embodiment of the vacuum adhesion system according to the invention, the processor (5) is arranged to detect a force that is being applied on the suction cup (3) based on the pressure differential. An advantage of this embodiment is that the electric system of the vacuum adhesion system can be simplified by omitting the force sensors (52). Such an embodiment it therefore cheaper to produce than embodiments with one or more separate force sensors (52). The applied force on the suction cup (3) can be detected by arranging the processor (5) to look for spikes in the pressure differential measurements (74) as shown in the graph in FIG. 25. A spike in the graph (74) is defined as an increase or decrease in the pressure differential that cannot be explained by an increase or decrease of the desired pumping speed, said desired pumping speed being determined by the processor (5) based on the value of the desired pressure differential (75). It is therefore assumed that this spike (74) originates from the force applied on the suction cup (3), which enlarges or shrinks the sealed volume underneath the suction cup (3) and thus creates a spike in the measured pressure differential (73). By looking at the magnitude (76) and steepness (77) of the spike compared to the value of the desired pressure differential (75) an estimate of the magnitude of the force applied on the suction cup (3) can be calculated by the processor (5). The steepness of the spike (77) needs to be taken into consideration because the magnitude of the spike (76) depends on how fast the force is applied on the suction cup (3). This is especially true in situations where a large amount of leakage occurs underneath the sealing rim (10). A force that is slowly applied on the suction cup (3) will yield a lower spike (74) in these situations than a force that is applied quickly, because the spike in the pressure differential (74) decays over time due to leakage underneath the sealing rim (10). To establish the relationship between the spike (74) and the force applied on the suction cup (3) a combined parameter for the magnitude and said steepness of the spike is created, wherein the steepness (77) is defined by the increase in the pressure differential divided by the time that pressure differential has been rising to create the spike (74). The combined parameter can for example be defined as the magnitude of the spike (76) divided the said steepness of the spike (77). Multiple tensile strength tests are subsequently performed in which a wide range of forces coming from multiple directions are applied on the suction cup (3), while recording the magnitude of the forces and the combined parameter of the spike. The lowest results from the tensile strength tests are plotted in a two-dimensional graph with on one axis the force and on the other axis the combined parameter of the spike, wherein the lowest results are defined by dividing the combined parameter of the spike with the force and taking a predefined percentage of the results that score the lowest. This percentage is typically below 10%. An equation, which is assumed to define the relationship between the combined parameter of the spike and the force, can subsequently be obtained from a trend line that is drawn in the graph in such a way that it matches the lowest results as closely as possible. Because the tensile strength tests are performed under various angles it can be stated that the force that is estimated by the processor (5) is independent from the angle under which the suction cup (3) is loaded. Because embodiments of the vacuum adhesion system can respond differently to a load, the prediction of the force applied on the suction cup (3) as described here needs to be calibrated each time a change is made to the vacuum adhesion system.

Figure 26:
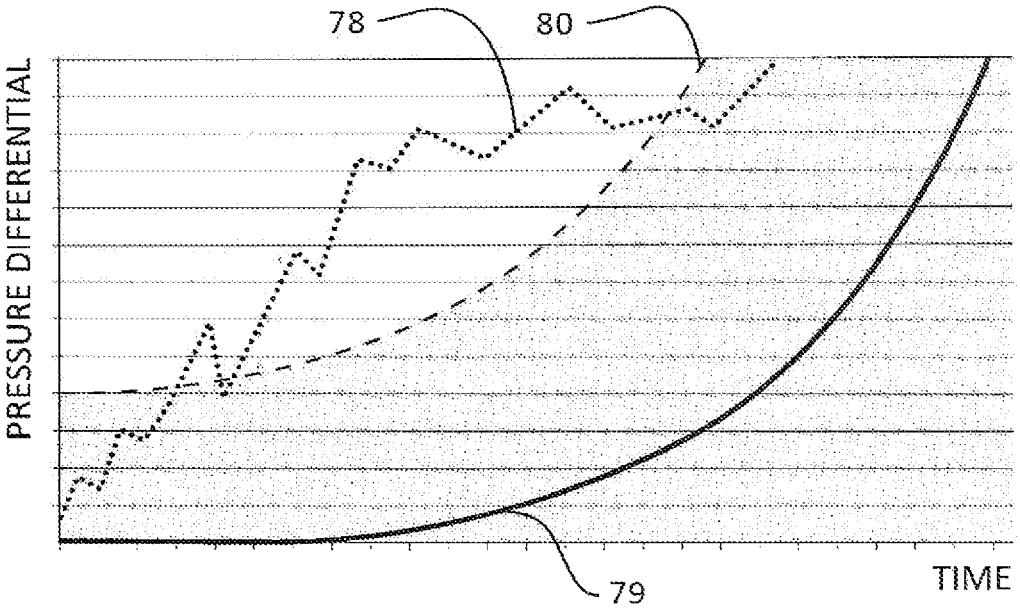
FIG. 26 shows a graph with two axes, time and pressure differential, in which an optimal pressure differential curve (79), error value curve (80) and pressure differential measurements of a clogged vacuum system are plotted (78).

In another embodiment of the vacuum adhesion system, the processor (5) is arranged to determine if the vacuum adhesion system requires maintenance based on the power consumption, the pumping speed and the pressure differential, wherein the processor (5) is arranged to provide a warning via the interface (6) if the power consumption, the pumping speed or the pressure differential are outside of predefined operating boundaries. An advantage of this embodiment is that warnings regarding the maintenance of the vacuum adhesion system can be provided to the operator (26) before hazardous situations arise. The function described here can for example be used to detect if the vacuum system is clogged or whether the components inside the vacuum pump (1) have worn. In order to determine whether the vacuum adhesion system requires maintenance the processor (5) engages the vacuum pump (1) shortly each time after the vacuum adhesion system is switched on. Subsequently the processor (5) gathers readings of the power consumption, the pumping speed and the measured pressure differential and compares them to predefined operating boundaries. If the readings are outside of the boundaries set for each of these parameters, then the processor (5) issues a warning via the interface (6) or may even prohibit the operator (26) from using the vacuum adhesion system in cases were the readings are far outside of the operating boundaries. Clogging of the vacuum system can be detected by looking at the first few instances after the vacuum pump (1) is engaged and before the pressure differential increases due to a seal which may be present at the sealing rim (10). The pressure differential curve belonging to a clogged vacuum system (78) reveals itself by small bump in the measured pressure differential that is caused by the resistance of the accumulated dust and debris against the airflow that is created by the vacuum pump (1) as shown in FIG. 26. The bump (78) is compared to an operating boundary that is predefined by measuring the pressure differential over time in a vacuum adhesion system that is in optimal condition and adding an error value to the optimal pressure differential curve (79). The error value curve (80) represents the maximum allowable deviation from the optimal pressure differential curve (79) and is typically defined as a percentage between 100% and 110% of the optimal pressure differential added to a fixed error value to prevent measurement inaccuracies from triggering the warning function. To determine the amount of wear on the components in the vacuum pump (1) it is assumed that wear causes a force of friction, which needs to be overcome in order to get the pumping element moving. This force of friction increases as the amount of wear in said vacuum pump progresses. During the start-up check, the power sent to the vacuum pump (1) is slowly increased until the pumping element starts moving, which is subsequently detected by the processor (5). The amount of power required to get the pumping element moving is assumed to have a direct relationship with the amount of wear of the vacuum pump (1) and is not allowed be higher than a predefined operating boundary. This predefined operating boundary is typically below 10% of the maximum power rating of the vacuum pump (1).

Figure 30:
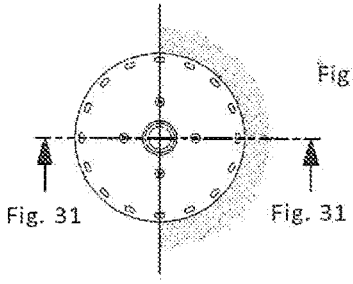
FIG. 30 shows a top view of the suction cup embodiment for high roughness surfaces (3*b*) and contains a line that defines the cross section in FIG. 31.
Figure 31:
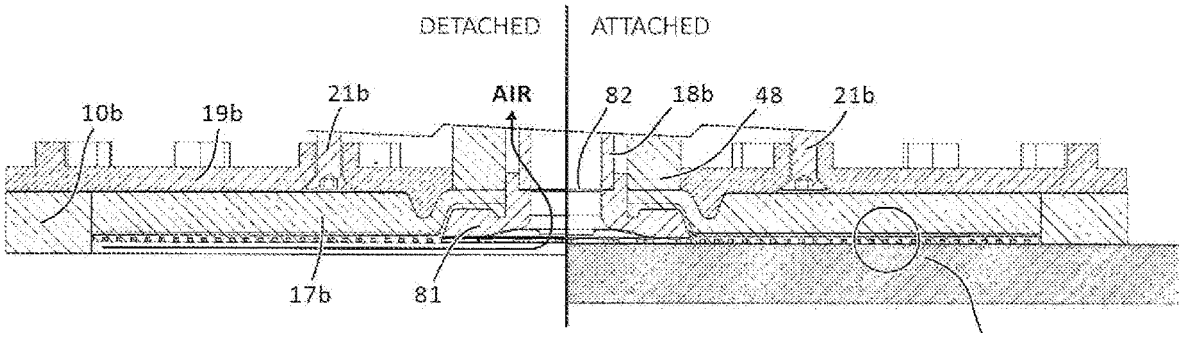
FIG. 31 shows a cross section of the suction cup embodiment for high roughness surfaces (3*b*) in a state where it detached and attached to an object.

On the bottom of the smart suction cup embodiment shown in FIG. 15 and FIG. 19 a suction cup embodiment for high roughness surfaces (3*b*) is present. This suction cup embodiment (3*b*) is based on the suction cup embodiment for medium roughness surfaces (3*a*) but differs in several ways to make it function better on surfaces with a high amount of roughness. In order to achieve this, the suction cup (3*b*) has a skeleton (19*b*) which connects to a system module (22) or any other rigid body that provides enough support to prevent the skeleton (19*b*) from bending. In between the skeleton (19*b*) and the rigid body, the bracket (50*a*) is placed, which in this embodiment has cutouts that allow the notches from the skeleton (19*b*) as shown in FIG. 30 and FIG. 31 to protrude and connect with the rigid body. To prevent interference with the load measurement of the force sensors, the cutouts in the bracket (50*a*) are dimensioned in such a way that they never touch the sides of the notches on the skeleton (19*b*). Through the notches of the skeleton (19*b*) four bolts (21*b*) are used to fix the skeleton (19*b*) to the rigid body and prevent it from falling when the locking ring (81) is removed. The rigidity of the described structure means that more pressure can be transmitted to the sealing rim (10*b*), which helps it to conform to larger asperities. To accommodate the additional movement of the surface of the sealing rim in this embodiment (10*b*) that has to conform to the larger surface asperities, it is much thicker and connects directly to the skeleton (19*b*) instead of the undersole (11).

Figure 27:
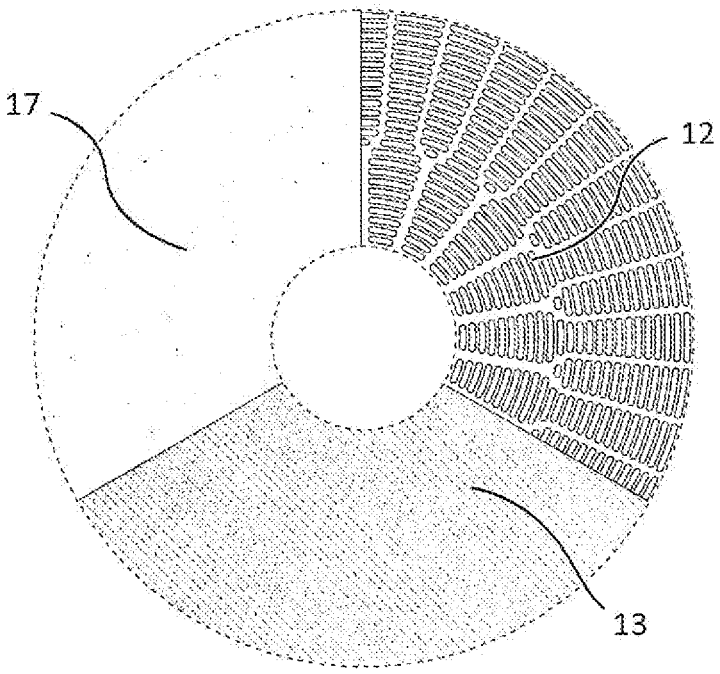
FIG. 27 shows the sections of the components of the undersole (11) which all suction cup embodiments (3*a*, 3*b*, 3*c*) have in common.
Figure 28:
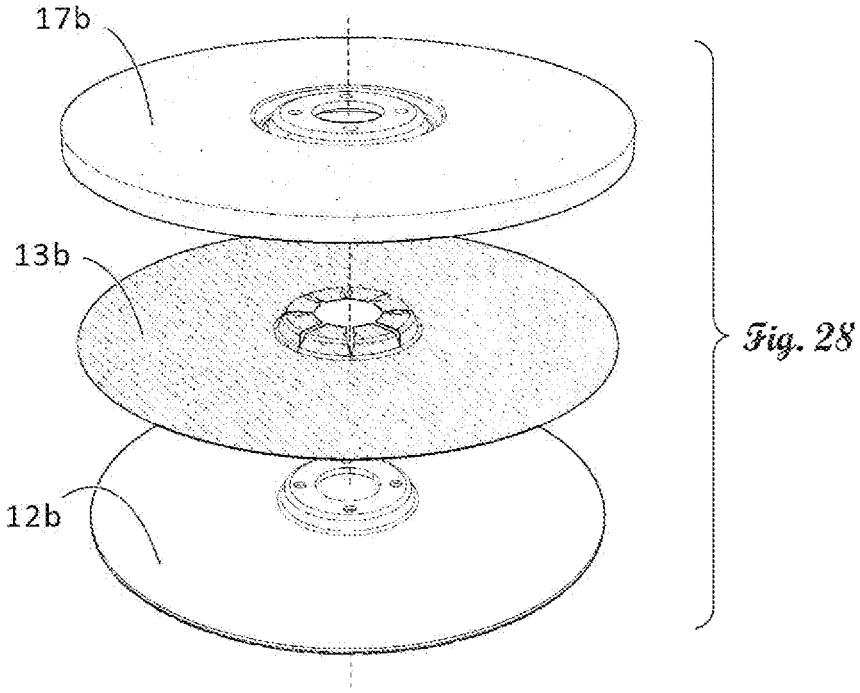
FIG. 28 shows an exploded view of the undersole for the suction cup embodiment for high roughness surfaces (11*b*).
Figure 29:
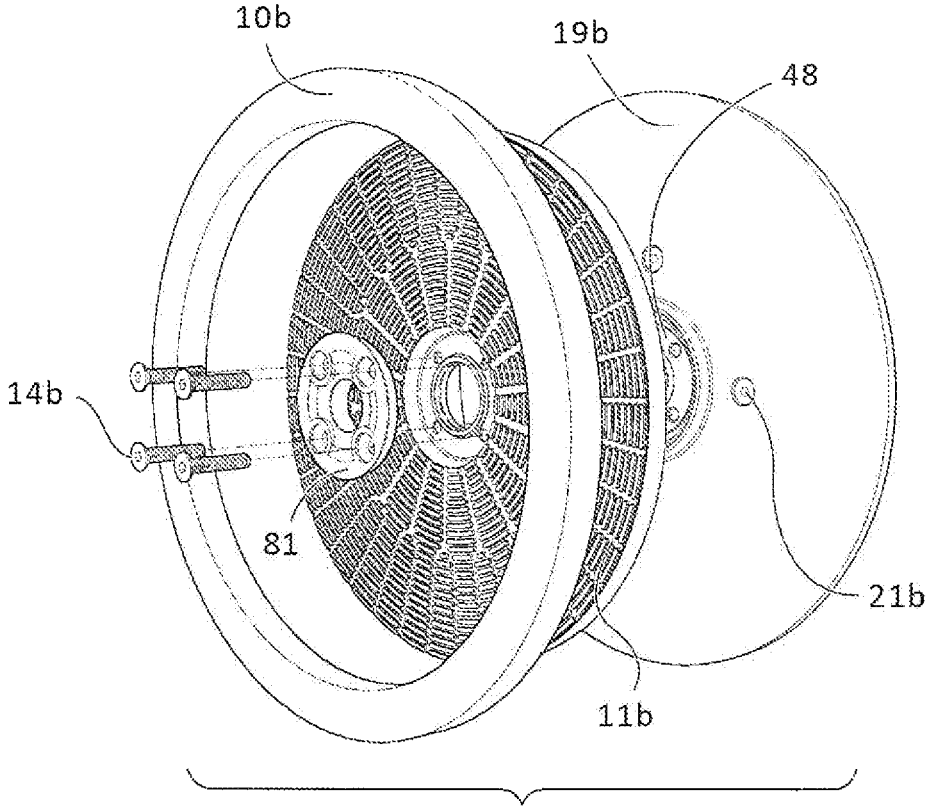
FIG. 29 shows an exploded view of the suction cup embodiment for high roughness surfaces (3*b*).
Figure 32:
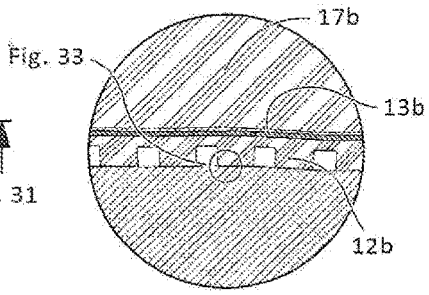
FIG. 32 shows a close-up of FIG. 27, which depicts how the suction cup undersole (11) conforms to small undulations on a surface.
Figure 33:
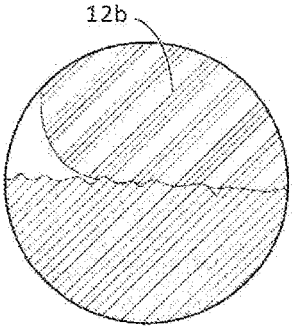
FIG. 33 shows a close-up of FIG. 28, which depicts how the suction cup undersole (11) conforms to the microstructure on a surface.

An advantage of this embodiment of the suction cup is that the operator (26) has more control over the positioning of an object, because there is no flexibility in the suction cup skeleton (19*b*). This allows the operator (26) to counteract forces that arise when an object starts to swing by applying an opposite force on the bracket (50). A downside of this design is that the suction cup (3*b*) can only attach itself to objects with a flat surface that is at least the size of the suction cup (3*b*) diameter. However, some minor deviations in the surface geometry can be handled, as shown in FIG. 32 and FIG. 33 as long as the sealing rim (10*b*) is able to form a seal around the entire circumference of the suction cup (3*b*). The undersole (11*b*) in this embodiment of the suction cup (3*b*) has the same structure and uses the same materials as the undersole shown in FIG. 6. Also, the pattern of the interconnected grooves on the underside of the undersole (11*b*) is identical to the pattern shown in FIG. 5. FIG. 27 shows which part of the undersole (11*a*) is reused in the suction cup embodiment for high roughness surfaces (11*b*). The center section of the undersole (11*b*) is modified in order to reduce the use costs of the suction cup (3*a*). In the embodiment of the suction cup (3*a*) shown in FIG. 2 the textile (13*a*) within the composite undersole (11*a*) is permanently fixed between the suction cup anchor pieces (14, 15), which means the anchor must be replaced together with the undersole (11*a*) when it is worn out. This is not the case in the modified embodiment of the suction cup (3*b*), because the textile layer (13*b*) is only held in place due the interlocking shapes of the skeleton (19*b*), manifold (48), undersole (11*b*) and locking ring (81) as shown in FIG. 31. To obtain an air tight seal between these components, the supporting foam layer (17*b*) and rubber layer (12*b*) of the undersole (11*b*) extend towards the middle of the suction cup (3*b*) in such a way that they are clamped in between the locking ring (81) and the manifold (48). This causes lateral expansion of the supporting foam layer (17*b*) and the rubber layer (12*b*), which subsequently forms a seal around four bolts (14*b*) that are used to mount the undersole (11*b*) and the locking ring (81) to the rest of the construction. When these bolts (14*b*) are removed the tubular filter (18*b*) can be cleaned. In contrast to the embodiment of the filter (18*a*) shown in FIG. 2, air travels from the center of the filter (18*b*) towards the sides of the manifold (48) as indicated by the arrow in FIG. 31. To prevent larger dust particles and debris from clogging up the filter (18*b*) it is shielded by a filter mesh (82) that is placed in a recessed section above the locking ring (81).

Because the suction cup embodiment for high roughness surfaces (3*b*) is unable to bend, it is unsuitable for lifting flexible materials. In order to detect when a flexible material is attached to the suction cup (3*b*), the locking ring (81) in this embodiment of the suction cup (3*b*) lacks the raised sections as shown on the bottom part of the suction cup anchor (15) in FIG. 4. This means that when air flows through the opening of the locking ring (81), the resulting pressure differential will push the flexible material against the locking rim (81), which results in an airtight seal. The resulting rapid increase of the pressure differential inside the vacuum system is larger than when a rigid material would have been attached to the suction cup (3*b*), because the volume of air inside the system is reduced by the seal on the locking ring (81). Such a spike can therefore be detected by the microcontroller (5). If the increase of the pressure differential is higher than a predetermined threshold value, it will issue a warning through the interface (6) which informs the operator (26) that an incompatible material is attached to the suction cup (3*b*). To prevent any ambiguity, the value of the predicted tensile strength of the suction cup (3*b*) that is shown on the interface (6) is subsequently reduced to zero.

In addition to the suction cup embodiments for rigid materials, which can attach themselves to surfaces with a varying degree of roughness (3*a*, 3*b*), another suction cup embodiment (3*c*) is disclosed that is optimized for attaching itself to more flexible materials, such as thin sheets of plastic or metal. The embodiment of the suction cup (3*c*) presented here is also able to conform its shape to objects with a complex surface geometry, such as stamped metal parts or tubular objects. This is made possible by replacing all rigid components from the previously described suction cup embodiments (3*a*, 3*b*) with flexible parts, such that the shape of the suction cup (3*c*) can be conformed to the object that needs to be lifted. At the beginning of the lifting process the operator (26) applies a force on the perimeter of the suction cup (3*c*) until a seal is established with the object. The pressure differential underneath the suction cup subsequently replaces this force, such that the suction cup (3*c*) is unable to peel off the object and a sturdy bond is achieved. This bond is reversible, and its strength can be controlled by varying the degree of vacuum in the vacuum system.

Figure 34:
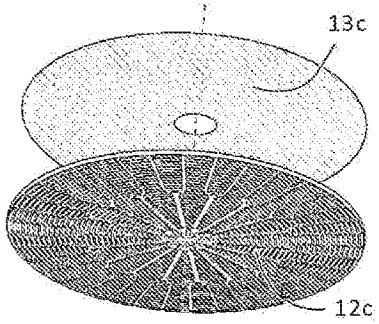
FIG. 34 shows an exploded view of the undersole belonging to the suction cup embodiment for low roughness surfaces (11*c*).

The suction cup embodiment (3*c*) presented here contains an embodiment of the suction cup undersole (11*c*) that has a large section in common with the undersole belonging to the suction cup embodiment for medium and high roughness surfaces (11*a*, 11*b*) as shown in FIG. 27. However, because this suction cup embodiment (3*c*) does not have a rigid skeleton (19) there is no need for a soft supporting foam layer (17) on top of the composite undersole (11). Therefore, the undersole of this embodiment of the suction cup (11*c*) only contains a soft rubber layer (12*c*) and a textile (13*c*) as shown in FIG. 34. These components (12*c*, 13*c*) have the same material properties as the textile (13*a*) and soft rubber matrix (12*a*) of the suction cup embodiment for medium roughness surfaces (3*a*). However, they lack a cup-shaped recess in the middle, since there is no suction cup anchor (15, 16) or locking ring (81) in this embodiment of the suction cup (3*c*). Instead the undersole (11*c*) is bonded to a casting (83) that forms the top half of the suction cup (3*c*). This casting (83) is made from a rubber has the same material properties as the soft rubber layer (12*c*) and bonds to several components as shown in FIG. 35.

Figure 35:
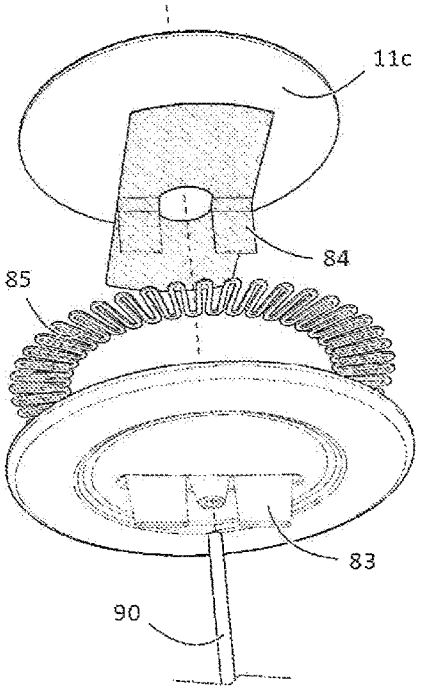
FIG. 35 shows an exploded view containing the undersole (11*c*) and the casting belonging to the suction cup embodiment for low roughness surfaces (83).
Figure 38:
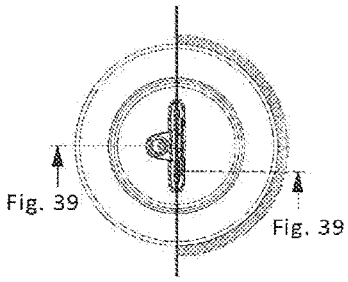
FIG. 38 shows a top view of the suction cup embodiment for low roughness surfaces (3*c*) and contains a line that defines the cross section in FIG. 39.

One of the components encapsulated in the casting (83) is a textile layer with a fold in the middle (84) that transmits the shear forces generated in the composite undersole (11*c*) to two mounting points, which form protrusions from the casting (83) as shown in FIG. 35 and FIG. 38. The fibers in the folded textile layer (84) lie parallel to its sides, so that they run continuously along the length of the folded textile layer (84). Additionally, the placement of the folded textile layer (84) is such that an angle of approximately 45 degrees is formed with the fiber direction of the textile layer (13*c*) in the composite undersole (11*c*). This placement makes sure that as much of the shear forces as possible are transmitted from the textile layer (13*c*) to the folded textile layer (84). To handle the forces that are transmitted onto the folded textile layer (84), it should at least have the same tensile strength as the textile (13*c*) that is present in the undersole.

Figure 36:
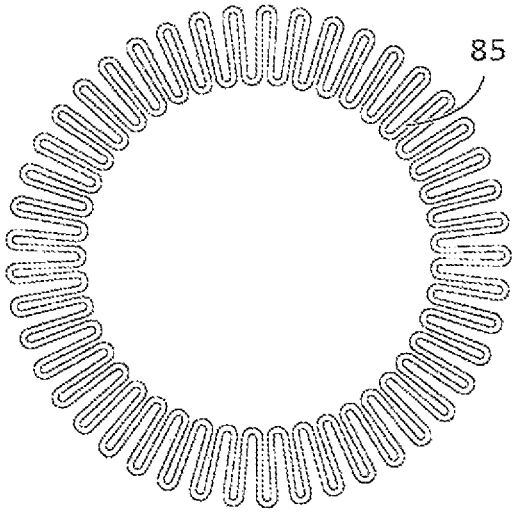
FIG. 36 shows a top view of the sealing rim skeleton belonging to the suction cup embodiment for low roughness surfaces (85).
Figure 37:
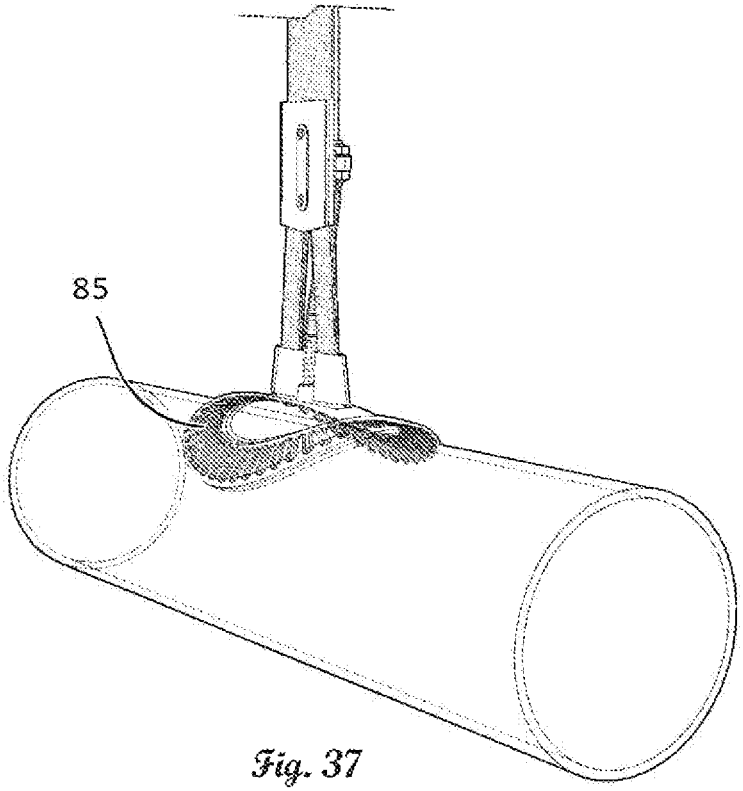
FIG. 37 shows the suction cup embodiment for low roughness surfaces (3*c*) attached to a curved object

The casting (83) shown in FIG. 35 furthermore contains a flexible sealing rim skeleton (85) as a flexible reinforcement element for reinforcing the suction cup (3*c*) or, in particular the sealing rim (10*c*) thereof, consisting of a thin beam that oscillates around the circumference of a virtual circle as shown in FIG. 36. The diameter of the virtual circle and the amplitude of the oscillation are chosen such that a load can be transmitted from the undersole (11*c*), upon which a pressure differential is acting, to an area towards the circumference of the casting (83) onto which the sealing rim is mounted (10*c*). The load that this skeleton (85) transmits makes sure that the sealing rim (10*c*) is pressed hard enough onto an object along its entire circumference to create a good seal with the object's surface. To achieve this the period of the oscillations in the skeleton (85) is chosen such that the pressure across the sealing rim is distributed as evenly as possible. The geometry of the sealing rim skeleton (85) makes it possible for the operator (26) to adjust the shape of the suction cup (3*c*) to large undulations in the surface of an object as shown in FIG. 37. Because the skeleton (85) is optimized for flexibility, the suction cup embodiment (3*c*) is only capable of attaching itself to surfaces with a low amount of roughness. This is exemplified by the small distance between the underside of the sealing rim (10*c*) and the undersole (11*c*) shown in FIG. 39.

Figure 40:
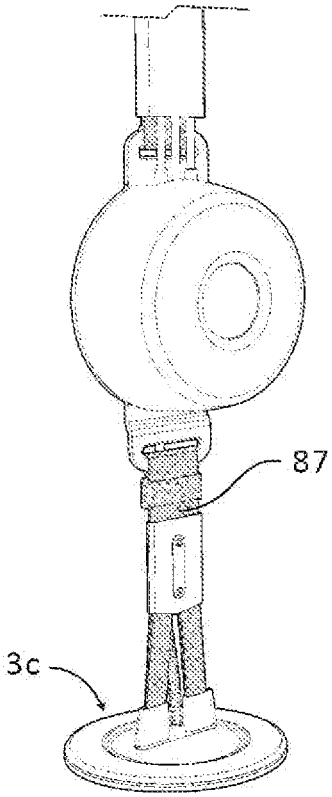
FIG. 40 shows the front of a smart suction cup consisting of the suction cup embodiment for low roughness surfaces (3*c*) in combination with an embodiment of the system module (22).
Figure 41:
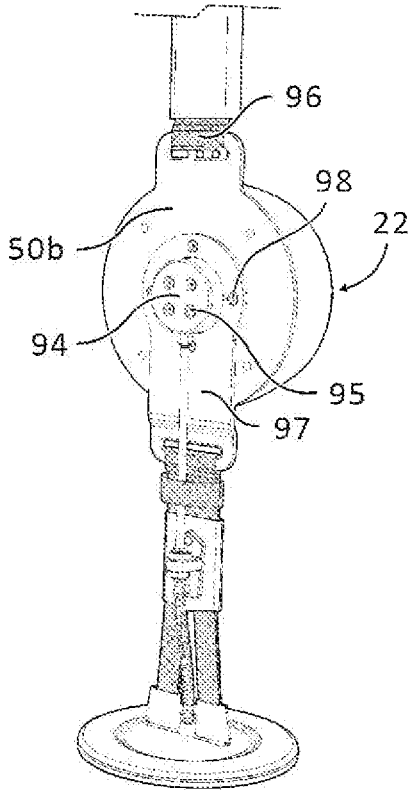
FIG. 41 shows the rear of a smart suction cup consisting of the suction cup embodiment for low roughness surfaces (3*c*) in combination with an embodiment of the system module (22).
Figure 42:
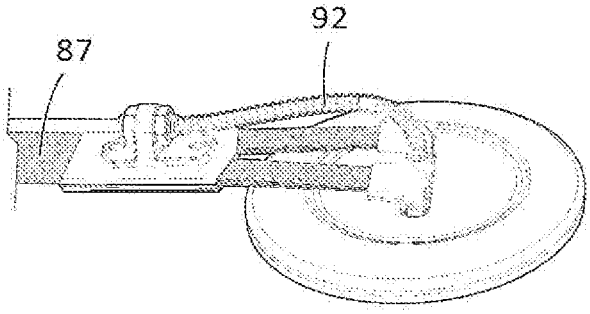
FIG. 42 shows the suction cup embodiment for low roughness surfaces (3*c*) when loaded parallel to the suction cup.
Figure 43:
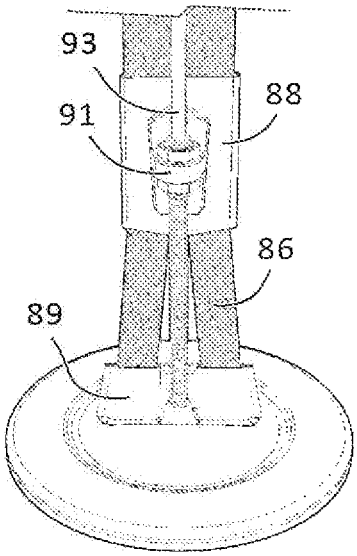
FIG. 43 shows the suction cup embodiment for low roughness surfaces (3*c*) when loaded perpendicular to the suction cup.

The suction cup embodiment for low roughness surfaces (3*c*) is not placed directly underneath a system module (22) or any other rigid body, as prescribed for the suction cup embodiment for high roughness surfaces (3*b*). This is because the operator (26) needs access to the top of the suction cup (3*c*) to be able to conform its shape to an object. It is therefore tethered to the rest of the vacuum adhesion system using a series of connected pieces of webbing as shown in FIG. 40 and FIG. 41. Four narrow pieces of webbing (86) are attached to the mounting points of the casting (83) under a small angle, allowing them to meet up some way above the suction cup (3*c*). In this meeting point they are mounted to a wider piece of webbing (87). To protect both the mounting points on the top and on the bottom of the narrow pieces of webbing (86), they are covered with protective sleeves (88, 89). The construction of the webbing pieces is such that a pneumatic hose (90) can freely move in between them. This allows the pneumatic hose (90) to have a larger bend radius then the mounting points on the casting (83), which is necessary in the situations where a load is applied parallel to the suction cup (3*c*) as shown in FIG. 42. Without such a construction the pneumatic hose (90) could buckle by coming in contact with the webbing, which would cut off the supply of vacuum to the suction cup (3*c*). The structure of the suction cup (3*c*) as described here allows it to resist forces in any direction between the parallel use scenario depicted in FIG. 42 and the use scenario depicted in FIG. 43, where a load is applied perpendicular to the suction cup (3*c*). The ability of the suction cup (3*c*) to resist forces in multiple directions means that it can be used in a larger amount of applications.

Figure 39:
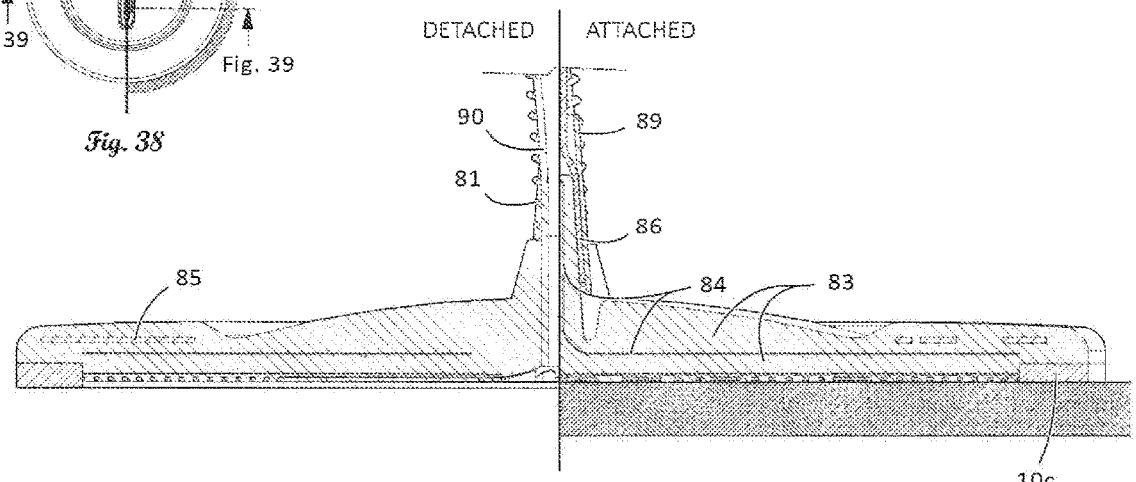
FIG. 39 shows a cross section of the suction cup embodiment for low roughness surfaces (3*c*) in a state where it detached and attached to an object.

To ensure that the pneumatic hose (90) stays in place in between the webbing, it is inserted into the casting (83) as shown in FIG. 35 and FIG. 39. The other side of the pneumatic hose (90) is fixed in place by inserting it into a pneumatic coupling that is part of a bracket (91), which is subsequently secured to the webbing sleeve (88). In between the mounting points of the pneumatic hose (90) it is reinforced with a wire (92) that coils around the hose, which further reduces the risk of buckling. A vacuum line (93), which is inserted into the other side of the pneumatic coupling (91) subsequently connects the suction cup (3*c*) to a system module as depicted in FIG. 40 and FIG. 41. In this embodiment of the smart suction cup the manifold (48) is sealed off with a cap (94) containing a pneumatic coupling that receives the vacuum line (93) coming from the suction cup (3*c*). The geometry of the cap (94) is such that air flows through the filter (18*b*) contained within the manifold (48) in the same way as described for the suction cup embodiment for high roughness surfaces (3*c*). The cap (94) is mounted to the manifold (48) using four bolts (95). In order to be able to put a load on the smart suction cup, the bracket (50*b*) has a cutout towards the top, which allows a strap (96) to be attached. This strap (96) connects to a frame (51) of the vacuum adhesion system or is tied to another smart suction cup. The central vacuum line (43) and electric cables (45) run along the strap (96) in order to exchange information, power and vacuum with other smart suction cups in the vacuum adhesion system.

Since there is no suction cup skeleton (19) to hold the bracket (50*b*) in place in this embodiment of the suction cup (3*c*), a bracket holder (97) with a cutout towards the bottom of the system module (22) is mounted on top of the bracket (50*b*). This bracket holder (97) is subsequently secured with four bolts (98) to the system module enclosure (53) in such a way that it does not interfere with the force measurements of the force sensors (52). Towards the bottom of the bracket holder (97), a cutout allows the wider piece of webbing (87) coming from the suction cup (3*c*) to be attached. In the described construction a load travels from the strap (96) to the bracket (50*b*). On the bracket (50*b*), the mounting blocks (54) transfer the load to the force sensors (52). Since the force sensors (52) in this embodiment of the smart suction cup are mounted on the system module (22), the load travels from the force sensors (52) through the system module enclosure (53) to the bracket holder (97). The load is then transmitted via the wider piece of webbing (87) and narrow pieces of webbing (86) to the suction cup undersole (11*c*) where it is resisted by the force of friction and suction adhesion that are being generated.

LIST OF DRAWING REFERENCES

1. One or more vacuum pumps
2. An electronic valve or any other suitable release valve
3. One or more suction cups
  a. In a particular embodiment that is optimized for medium roughness and slightly curved surfaces
  b. In a particular embodiment that is optimized for high roughness, rigid and flat surfaces
  c. In a particular embodiment that is optimized for low roughness, flexible and curved surfaces
4. A vacuum sensor
5. One or more microcontrollers or any other suitable processors
6. An interface
7. A manual switch between the power source and the vacuum pump, part of the stand-alone embodiment of the smart suction cup.
8. A manual switch between the power source and the electronic valve, part of the stand-alone embodiment of the smart suction cup.
9. A power source
10. A sealing rim made from a closed cell foam with a shore OO durometer of between 20 and 40.
  a. In a particular embodiment belonging to the suction cup embodiment for medium roughness surfaces (3*a*)
  b. In a particular embodiment belonging to the suction cup embodiment for high roughness surfaces (3*b*)
  c. In a particular embodiment belonging to the suction cup embodiment for low roughness surfaces (3*c*)
11. A composite suction cup undersole
  a. In a particular embodiment belonging to the suction cup embodiment for medium roughness surfaces (3*a*)
  b. In a particular embodiment belonging to the suction cup embodiment for high roughness surfaces (3*b*)
  c. In a particular embodiment belonging to the suction cup embodiment for low roughness surfaces (3*c*)
12. A soft rubber layer with an elastic modulus of between 1500 Mpa and 4000 Mpa
  a. In a particular embodiment belonging to the suction cup embodiment for medium roughness surfaces (3*a*)
  b. In a particular embodiment belonging to the suction cup embodiment for high roughness surfaces (3*b*)
  c. In a particular embodiment belonging to the suction cup embodiment for low roughness surfaces (3*c*)
13. A strong textile layer with a tensile strength of between 1500 Mpa and 4000 Mpa
  a. In a particular embodiment belonging to the suction cup embodiment for medium roughness surfaces (3*a*)
  b. In a particular embodiment belonging to the suction cup embodiment for high roughness surfaces (3*b*)
  c. In a particular embodiment belonging to the suction cup embodiment for low roughness surfaces (3*c*)
14. One or more bolts for securing the suction cup undersole (11) to the rest of the construction
  a. In a particular embodiment belonging to the suction cup embodiment for medium roughness surfaces (3*a*)
  b. In a particular embodiment belonging to the suction cup embodiment for high roughness surfaces (3*b*)
15. A top part of the suction cup anchor belonging to the suction cup embodiment for medium roughness surfaces (3*a*)
16. A bottom part of the suction cup anchor belonging to the suction cup embodiment for medium roughness surfaces (3*a*)

17. A soft supporting foam layer
  a. In a particular embodiment belonging to the suction cup embodiment for medium roughness surfaces (3*a*)
  b. In a particular embodiment belonging to the suction cup embodiment for high roughness surfaces (3*b*)
18. A tubular filter
  a. In a particular embodiment belonging to the stand-alone embodiment of the smart suction cup
  b. In a particular embodiment belonging to the modular embodiment of the smart suction cup
19. A suction cup skeleton
  a. In a particular embodiment belonging to the suction cup embodiment for medium roughness surfaces (3*a*)
  b. In a particular embodiment belonging to the suction cup embodiment for high roughness surfaces (3*b*)
20. An O-ring belonging to the suction cup embodiment for medium roughness surfaces (3*a*)
21. One or more bolts for securing the suction cup skeleton (19) to a system module (22) or any other rigid body
  a. In an embodiment belonging to the suction cup embodiment for medium roughness surfaces (3*a*)
  b. In an embodiment belonging to the suction cup embodiment for high roughness surfaces (3*b*)
22. One or more system module belonging to the modular embodiment of the smart suction cup
23. One or more master system module belonging to the modular embodiment of the smart suction cup
24. One or more slave system module belonging to the modular embodiment of the smart suction cup
25. One or more voltage regulator belonging to the modular embodiment of the smart suction cup
26. A user or any other suitable operator that controls the vacuum adhesion system
27. A Bluetooth transceiver
28. An NFC transceiver
29. A Wi-Fi transceiver
30. One or more smart devices, such as a tablet or a smart phone
31. One or more other system modules (22) belonging to the same vacuum adhesion system
32. One or more touch sensors
33. One or more buttons
34. One or more microphones
35. One or more accelerometers
36. One or more gyroscopes
37. One or more displays
38. One or more LEDs
39. One or more speakers
40. One or more haptic feedback actuators
41. A master system module embodiment in the form of a human-machine interface
42. A pneumatic connector belonging to the modular embodiment of the smart suction cup
43. A central vacuum line with branching pneumatic tubes belonging to the modular embodiment of the smart suction cup
44. A combined connector for data and power transmission belonging to the modular embodiment of the smart suction cup
45. One or more electric cables belonging to the modular embodiment of the smart suction cup
46. An electronic valve for connecting a system module to the central vacuum line (43) belonging to the modular embodiment of the smart suction cup
47. A check valve belonging to the modular embodiment of the smart suction cup
48. A manifold belonging to the modular embodiment of the smart suction cup
49. A battery pack belonging to the modular embodiment of the smart suction cup
50. A bracket belonging to the modular embodiment of the smart suction cup
  a. In a particular embodiment belonging to the suction cup embodiment for high roughness surfaces (3*b*)
  b. In a particular embodiment belonging to the suction cup embodiment for low roughness surfaces (3*c*)
51. A rigid frame
  a. In a particular embodiment that connects 5 smart suction cups
  b. In a particular embodiment that connects 4 smart suction cups
52. One or more force sensors belonging to the modular embodiment of the smart suction cup
53. An embodiment of the enclosure of a system module belonging to the modular embodiment of the smart suction cup.
54. One or more mounting blocks belonging to the modular embodiment of the smart suction cup
55. One or more soft elastic feet belonging to the modular embodiment of the smart suction cup
56. The first force sensor belonging to an embodiment of the system module (22) with four force sensors (50)
57. The second force sensor belonging to an embodiment of the system module (22) with four force sensors (50)
58. The third sensor belonging to an embodiment of the system module (22) with four force sensors (50)
59. The fourth force sensor belonging to an embodiment of the system module (22) with four force sensors (50)
60. A force vector belonging to a force acting on the bracket (50) and that is subsequently applied on the suction cup (3)
61. A force vector belonging to a force acting on force sensor 1 (56)
62. A force vector belonging to a force acting on force sensor 2 (57)
63. A force vector belonging to a force acting on force sensor 3 (58)
64. A force vector belonging to a force acting on force sensor 4 (59)
65. An angle belonging to a virtual cone that controls the placement and measurement range of the force sensors (52)
66. A measurement plane that lies parallel to the suction cup (3) belonging to force sensor array (56, 57, 58, 59)
67. A force vector that results from projecting the force vector belonging to force sensor 1 (61) on the parallel measurement plane (66)
68. A force vector that results from projecting the force vector belonging to force sensor 2 (62) on the parallel measurement plane (66)
69. One or more out of four force vector belonging to forces acting on the suction cups (3) of a vacuum adhesion system consisting out of four smart suction cups
70. A force vector that represents the total force that acts on the frame (51) of the vacuum adhesion system consisting out of four smart suction cups
71. One or more lever arms
72. A moment acting around the z-axis of the frame (51) belonging to the vacuum adhesion system embodiment consisting out of four smart suction cups

73. One or more pneumatic mufflers belonging to the modular embodiment of the smart suction cup

74. An array of pressure differential measurements showing a spike and connected with a dotted line

75. A value of the desired pressure differential represented by a solid line

76. The magnitude of the spike in the array of pressure differential measurements (72)

77. The steepness of the spike in the array of pressure differential measurements (72)

78. An array of pressure differential measurements showing a bump at the onset of the graph and connected with a dotted line

79. A pressure differential curve that belongs to an embodiment of the vacuum adhesion system that is in optimal condition represented by a solid line

80. An error value curve that represents the operating boundary and is visualized using a line with intermittent stripes

81. A locking ring belonging to the suction cup embodiment for high roughness surfaces (3*b*)

82. A filter mesh belonging to the suction cup embodiment for high roughness surfaces

83. A casting that forms the top half of the suction cup embodiment for low roughness surfaces (3*c*)

84. A textile layer with a fold in the middle belonging to the suction cup embodiment for low roughness surfaces (3*c*)

85. A flexible sealing rim skeleton belonging to the suction cup embodiment for low roughness surfaces (3*c*)

86. One or more narrow pieces of webbing belonging to the suction cup embodiment for low roughness surfaces (3*c*)

87. A wider piece of webbing belonging to the suction cup embodiment for low roughness surfaces (3*c*)

88. A protective sleeve covering the top mounting point of a narrow piece of webbing (75) to the wider piece of webbing (76) belonging to the suction cup embodiment for low roughness surfaces (3*c*)

89. One or more protective sleeves covering the bottom mounting points of the narrow pieces of webbing (75) to the casting (72) belonging to the suction cup embodiment for low roughness surfaces (3*c*)

90. A pneumatic hose belonging to the suction cup embodiment for low roughness surfaces (3*c*)

91. A bracket containing a pneumatic coupling belonging to the suction cup embodiment for low roughness surfaces (3*c*)

92. A coiled reinforcement wire belonging to the suction cup embodiment for low roughness surfaces (3*c*)

93. A vacuum line belonging to the suction cup embodiment for low roughness surfaces (3*c*)

94. A sealing cap containing a pneumatic coupling belonging to the suction cup embodiment for low roughness surfaces (3*c*)

95. One or more sealing cap (83) bolts belonging to the suction cup embodiment for low roughness surfaces (3*c*)

96. A strap

97. A bracket holder belonging to the suction cup embodiment for low roughness surfaces (3*c*)

98. One or more bracket holder (86) bolts belonging to the suction cup embodiment for low roughness surfaces (3*c*)

The invention claimed is:

1. A vacuum adhesion system, comprising:

(a) at least one suction cup having a suction surface for attaching to a surface;

(b) at least one system module, comprising:

(i) at least one vacuum pump connecting to the suction cup for applying a vacuum to the suction surface for providing suction adhesion;

(ii) at least one indicator or sensor for indicating or measuring a pressure differential in the suction cup;

(iii) at least one interface for communicating said measured pressure differential or a value based thereon; and (iv) a processor for controlling said vacuum adhesion system; and (c) at least two force sensors, each force sensor being arranged to measure a force in a different direction, wherein said processor is connected to said force sensors and arranged to determine a magnitude and direction of the force applied onto said suction cup, wherein said interface is arranged for communicating said magnitude and said direction of said applied force on said suction cup.

2. The vacuum adhesion system according to claim 1, wherein said processor is arranged to determine a maximum force which said suction surface can resist before detachment from said surface based on said pressure differential, wherein said interface is arranged for communicating said maximum force or value based thereon.

3. The vacuum adhesion system according to claim 1, wherein said processor is connected to said vacuum pump and arranged to adjust a pumping capacity of the vacuum pump based on said measured pressure differential.

4. The vacuum adhesion system according to claim 1, further comprising a release valve for releasing the pressure differential in the suction cup for detaching from said surface.

5. The vacuum adhesion system according to claim 1, comprising at least two system modules that are interconnected wherein said system modules are arranged to share information and/or pumping capacity and/or electric power.

6. The vacuum adhesion system according to claim 5, wherein one of said at least two system modules is a master system module and the other one(s) is/are a slave system module(s), wherein said master system module is arranged to give commands to said slave system module(s) and wherein said slave system module(s) is/are arranged to execute said commands and to provide a status update to said master system module, wherein the master system module is arranged to communicate said status update(s) via said interface belonging to said master system module.

7. The vacuum adhesion system according to claim 6, wherein said master system module is arranged to give said commands based upon said status updates and/or inputs provided through said interface belonging to said master system module.

8. The vacuum adhesion system according to claim 7, said commands being chosen from a group comprising:

(a) an attach command means;

(b) a detach command means;

(c) an assist command means to other system module(s); and (d) an increase or decrease pumping capacity command means.

9. The vacuum adhesion system according to claim 8, wherein said processor in said system module is arranged to instruct said vacuum pump(s) to start pumping when said force sensor(s) sense(s) contact is made with said surface and said system module has been given said attach command.

10. The vacuum adhesion system according to claim 9, wherein said processor in said system module is arranged to instruct said vacuum pump(s) to stop pumping and open a release valve when no or a small force is sensed by said force sensor(s) and said system modules have been provided with said detach command.

11. The vacuum adhesion system according to claim 10, wherein said at least two system modules are physically connected to each other by means of a rigid frame, wherein said processor belonging to said master system module is arranged to determine the magnitude and direction of the force acting on said rigid frame based on said status updates, wherein said force acting on said rigid frame is communicated via said interface belonging to said master system module.

12. The vacuum adhesion system according to claim 11, wherein the dimensions of said frame are entered into said processor, and wherein said processor belonging to said master system module is arranged to determine the moments acting on said rigid frame based on said status updates, wherein said moments acting on said rigid frame are communicated via said interface belonging to said master system module.

13. The vacuum adhesion system according to claim 1, wherein said indicator for indicating said pressure differential in the suction cup comprises a means for determining a power consumption and pumping speed of the vacuum pump, wherein said processor is arranged to determine said pressure differential based on said power consumption and said pumping speed.

14. The vacuum adhesion system according to claim 13, wherein said processor is arranged to determine if the vacuum adhesion system requires maintenance based on said power consumption, said pumping speed and said measured pressure differential or value based thereon, wherein the processor is arranged to provide a warning via said interface if said power consumption, said pumping speed or said measured pressure differential or value based thereon are outside of predefined operating boundaries.

15. The vacuum adhesion system according to claim 1, wherein said suction cup is flexible such that it is adjustable to a shape of the surface and is attached to said system module in a movable and/or flexible manner, and wherein said suction cup comprises a flexible reinforcement element for reinforcing said suction cup or, if provided, one or more sealing rim(s).

* * * * *